US005503092A

United States Patent [19]

Aubourg et al.

[11] Patent Number: 5,503,092

[45] Date of Patent: Apr. 2, 1996

[54] METHOD AND SYSTEM OF TUFTING

[75] Inventors: Peter L. Aubourg, Otford; Robert G. Pongrass, Woollahra; William B. Wilson, Davidson, all of Australia

[73] Assignee: Wilcom Tufting Pty. Ltd., Chippendale, Australia

[21] Appl. No.: 190,070

[22] PCT Filed: Aug. 3, 1992

[86] PCT No.: PCT/AU92/00401

§ 371 Date: Aug. 29, 1994

§ 102(e) Date: Aug. 29, 1994

[87] PCT Pub. No.: WO93/03215

PCT Pub. Date: Feb. 18, 1993

[30] Foreign Application Priority Data

Aug. 2, 1991 [AU] Australia ..... PK7580

[51] Int. Cl.[6] ..... D05C 15/26; D05B 3/00

[52] U.S. Cl. ..... 112/80.23; 112/80.08; 112/470.01; 112/470.13

[58] Field of Search ..... 112/80.23, 80.24, 112/121.14, 121.12, 121.11, 103, 117, 118, 119, 80.08, 470.01, 470.06, 470.12, 470.13, 470.14

[56] References Cited

U.S. PATENT DOCUMENTS

| | | | |
|---|---|---|---|
| 3,450,076 | 6/1969 | Bender . | |
| 4,309,950 | 1/1982 | Franklin | 112/121.12 X |
| 4,849,902 | 7/1989 | Yokoe et al. | 112/80.23 X |
| 5,227,976 | 7/1993 | Hayakawa | 112/80.23 X |
| 5,299,514 | 4/1994 | Hayakawa et al. | 112/121.12 |

FOREIGN PATENT DOCUMENTS

WO86/00098 1/1986 Australia .

*Primary Examiner*—Paul C. Lewis

*Attorney, Agent, or Firm*—Dressler, Goldsmith, Shore & Milnamow, Ltd.

[57] ABSTRACT

A method and system for tufting fabrics are disclosed. In addition a number of alternative tufting heads are disclosed. The method and system take into account at least one of the following factors: the direction of traverse with respect to filaments, any change in direction of traverse, the yarn type and thickness, the orientation of the needle with respect to the filaments, the distorting effect the needle has on the filament grid network when it is inserted into the backing, and the backing. The position of the needle relative to the positions of the tufts in the pattern is adjusted in order to compensate for positional errors introduced by the factors mentioned. The tufting heads are also modified to make them suitable for automation.

38 Claims, 18 Drawing Sheets

METHOD AND SYSTEM OF TUFTING

TECHNICAL FIELD

This invention concerns a method of automatically tufting fabrics, and a system for automatically tufting fabrics. In a further aspect it concerns a tufting head mechanism.

BACKGROUND ART

Tufted carpets are commonly made by inserting tufts of wool, or other yarns, into a backing to form a closely spaced array. A series of needles are used for this purpose, and each needle inserts a row of tufts into the backing as the backing is drawn away from the needle. If one of the needles stops tufting for some reason, for instance if the yarn breaks, then the tufting operation is not stopped but is allowed to continue leaving an empty row in the carpet. Subsequently a hand-held tufting gun is used to insert the missing row of tufts.

The hand-held tufting guns developed for the repair of carpets have been imaginatively applied to the creation of individualised carpets bearing complex and unusual designs; in these carpets it should be appreciated that the tufting is not restricted to straight rows. However, the production of such carpets is a highly labour intensive process and requires great skill and flair on the part of the operator. For instance, the stitch length is determined by a combination of the speed at which the operator traverses the gun across the backing and the speed at which the operator drives the tufting motion of the gun. It is also difficult to traverse the gun accurately across the backing because the action of the gun on the backing introduces forces which deflect the needle.

The hand-held tufting guns include tufting head mechanisms which typically include a reciprocally mounted hollow needle and a yarn feeding mechanism. There are two main types of tufting heads.

First, a purely mechanical type in which a forked rod, or narrow scissors, reciprocates within the hollow needle to drive the yarn into position once the backing has been parted by the needle.

Second, a pneumatic tufting head which uses a stream of compressed air flowing down through the hollow needle to entrain the yarn and drive it into position in the backing.

Both types of tufting guns are subject to a variety of problems in operation, such as yarn blockages, or yarn being blown back out of the needle. These problems make the use of tufting guns difficult to automate.

One attempt at an automated tufting gun is described in U.S. Pat. No. 4,109,593. Here a pneumatic tufting gun is mounted on a carriage movable in two orthogonal directions, and the problem of maintaining the correct orientation of the needle with respect to the direction of traverse is addressed. However, there are still a large number of problems to be overcome before such a device is able to produce an adequate product.

SUMMARY OF THE INVENTION

The present invention comprises a method of automatically tufting fabrics in cut or loop pile, comprising the steps of:

(a) stretching a backing over a frame to form a network of filaments extending in at least two directions;

(b) traversing a tufting head over the backing under the influence of control signals, and reciprocating a needle in the tufting head into and out of the backing at a rate related to the speed of traverse, to insert tufts of yarn into the backing in accordance with a preselected pattern of tufts;

(c) taking account of one or more of the following factors:
the direction of traverse with respect to the filaments;
any change in the direction of traverse;
the yarn type and thickness;
the orientation of the needle with respect to the filaments;
the distorting effect of the (large) needle; and
the backing type; and (d) adjusting the positions of the needle relative to the tufts in the pattern, in dependence on the factors taken into account in (c) to compensate for errors introduced by those factors.

Adjustment of the positions of the needle relative to the tufts in the pattern can be accomplished by varying the location of the tufts in the pattern, varying the control signals, or by mechanically compensating the traversing and tufting head mechanisms.

The importance of compensation is that errors in tuft location in the backing of the order, even, of a millimeter can be enough to destroy the homogeneity of the density of the tufts, which results in a less pleasing product. This is especially important at colour interfaces where any misplaced tufts can result in a fuzzy looking interface.

Preferably the method includes the step of adjusting the positions of the needle relative to the positions of the tufts in the pattern, in dependence on the distance between the position of a tuft center, and the position where the needle tip begins to enter the backing in order to sew that tuft.

Preferably the method includes the step of defining the pattern by vectors which represent either the length and direction of each row of tufts, or the shape and size of each area of tufts.

Preferably the method includes the step of calculating an integral number of tufts along the length of a line of tufts, which may be curved, from its beginning to its end.

Preferably the method includes the step of calculating an integral number of lines across any area.

Preferably the method includes the step of varying the spacing between lines on either side of, and parallel to, a boundary between two areas, within predetermined tolerances, in order to maintain line spacing at the boundary within the predetermined tolerances.

Preferably the method includes, where an area has two tapering boundaries, the step of tufting rows in a tapered formation between the two boundaries to share an equal proportion of the taper between each adjacent pair of rows.

Preferably the method includes the step of calculating an integral number of tufts along any given row in dependence on the spacing between that row and its immediately adjacent rows in order to ensure the tuft density remains within predetermined upper and lower limits.

Preferably the method includes the step of displaying the pattern as a diagram showing the arranged rows of tufts, wherein the displayed rows of tufts show their widths in scale with their lengths.

Preferably the method includes the step of checking the pattern for any occurrences of localised tuft density falling outside predetermined upper and lower limits.

Preferably the method includes the step of pressing the tufting head against the backing during tufting at a preselected pressure to cause a desired deflection of the backing.

Preferably the method includes the step of mounting the frame onto a machine which includes means for traversing the tufting head over the backing, before tufting, and dismounting the frame from the machine once tufting has been completed.

The invention also concerns a system for automatically tufting fabrics, comprising:

a frame over which, in use, a backing is stretched to form a network of filaments extending in at least two directions;

traversing means to traverse a tufting head over the backing under the influence of control signals;

a tufting head mounted in the traversing means and having a tufting needle able to reciprocate into and out of the backing, at a rate related to the speed of traverse, to insert tufts of yarn into the backing in accordance with a preselected pattern of tufts; and adjusting means to adjust the positions of the needle relative to the positions of the tufts in the pattern in dependence on one or more of the following factors:
the direction of traverse with respect to the filaments,
any change in direction of traverse,
the yarn type and thickness,
the orientation of the needle with respect to the filaments,
the distorting effect of the (large) needle, and
the backing type, to compensate for positional errors introduced by those factors.

Preferably the adjusting means comprises a design means which varies the location of the tufts in the pattern, a control means which varies the control signals, or mechanical offsets in the traversing means and tufting head.

Preferably the design means defines the pattern by a series of vectors which represent either the length and direction of each row of tufts, or the shape and size of each area of tufts.

Preferably the system includes means to calculate an integral number of tufts along the length of a line of tufts, which may be curved, from its beginning to its end.

Preferably the system includes means to calculate an integral number of lines across any area.

Preferably the system includes means to vary the spacing between lines on either side of, and parallel to, a boundary, between two areas, within predetermined tolerances, in order to ensure the line spacing at the boundary remains within the predetermined tolerances.

Preferably the design means includes display means to display the pattern showing each row of tufts with their widths in scale with their lengths.

Preferably the system includes means to check the pattern for any occurrences of localised tuft density falling outside predetermined upper and lower limits.

Preferably the traversing means and tufting head cooperate to enable the head to be pushed against the backing to cause any desired deflection of the backing.

Preferably the frame is mounted on the traversing means before tufting, and demounted from the traversing means once tufting has been completed.

Preferably the tufting head comprises:

a yarn feed mechanism which engages the yarn, in each reciprocation of the needle, to feed it to the needle as the needle descends after the tip of the needle has entered the backing but before the needle opening is completely clear of the backing, and disengages to stop feeding before the tip of the needle is clear of the backing;

an air feeder to pump a stream of air through the needle and entrain the yarn, and feed it through the needle; and a yarn brake provided upstream of the yarn feed mechanism to prevent advance of the yarn when the feed mechanism is disengaged; wherein the yarn feed mechanism comprises a pair of pinch wheels, at least one of which is driven in rotation and has a portion of its periphery arranged to engage the other wheel as it rotates, and a portion of its periphery arranged not to engage the other wheel as it rotates.

Interrupting the yarn drive in each reciprocation provides greater reliability than known devices. This is because in the known devices the yarn is continuously advanced and can become entangled in the filaments of the backing before they are fully parted. The intermittent drive also results in greater consistency of pile height than is typical of known machines, since the beginning and end of each length of yarn is accurately defined in embodiments of the invention. In addition the intermittent drive facilitates clean cutting of the yarn by allowing the yarn to be cut while it is stationary in some embodiments.

Preferably the head further comprises a yarn cutting device which operates to pass a blade through a transverse slot in the needle once in every reciprocation at a time when the yarn is stationary and the needle is advancing toward the backing, to cut against an anvil placed at an acute angle to the blade.

Preferably the needle has an S-shaped profile.

Preferably the head further comprises a continuous disc-shaped foot having a hole through which the needle reciprocates, the hole being elongated behind the trailing edge of the needle.

Preferably the head further comprises a yarn blockage detector located between the yarn feed mechanism and the needle, to indicate divergence or build-up of yarn, or both, in that region.

Preferably the head further includes a yarn change device comprising a tube having a relatively narrow opening adjacent the yarn feed mechanism, and a relatively wide opening at its distal end, and air feed means selectively operable to direct a stream of air either from the wide to the narrow end of the tube to entrain yarn and feed it to the yarn feed mechanism, or from the relatively narrow to the wide end to eject yarn from the tufting head.

One of the problems with the known automated tufting heads is that the motor which drives the tufting head is mounted on the rotating parts of the head. Power and control signals must be fed to the motor by means of a rotatable coupling. Slip rings have been found impractical since they are bulky and unreliable in transmitting the control signals, and a spiral wound wire loom has been employed. The spiral loom introduces a restriction on a number of times the tufting head can rotate in a single direction, and when the spiral is fully wound in one direction the tufting head is forced to change the direction of its rotation, which can result in a rotation through a much larger angle being required than would be necessary if a change in the direction rotation were not necessary. The extra rotational movement costs valuable production time, and also may result in distortion of the tuft as the rotation of the needle may pull the yarn. The spiral loom, as well as being expensive, is also prone to wire failures as a result of continual winding.

Preferably the system includes a reciprocating drive motor to drive the needle in reciprocation, and a rotational drive motor to rotate the needle about an axis, both mounted on a non-rotatable part of the traversing means to supply drive to a rotatable part of the tufting head respectively by means of a first drive wheel and a second drive wheel which are both mounted on the rotatable parts to be driven in rotation about the axis; and wherein in use, rotational drive of the first drive wheel is translated into reciprocating motion of the needle and rotational drive of the second drive wheel directly causes rotation of the needle about the axis.

Where the tufting head comprises a forked blade mounted within the needle for reciprocating motion, out of phase with the needle to locate the yarn in the backing; then preferably, both the needle and the forked blade are attached to respective tubes, both coaxial with an axis about which the needle is rotatable, both rotatable about that axis, and both attached at their upper ends by means of rotatable couplings to respective carriages which are not rotatable about that axis but which are both drivable in reciprocating motion to supply the reciprocating motion to the needle and blade.

These arrangements allow the tufting drive motor to be mounted on a non-rotating part of the tufting gun, and this reduces the rotational moment of inertia of the rotating part, which reduces the power and time required to move from one rotational position to another.

In known machines of the purely mechanical type the yarn takes a circuitous route through the mechanism which results in a friction drag load being applied to the yarn, which can cause the yarn to be damaged or even cut before the yarn brake is applied. This effect is particularly prevalent at high speed operation, and in the known machines it is necessary to restrict the speed in order to ensure the yarn is not damaged. Therefore preferably the yarn is fed through a tube which is not rotatable about the axis, and which passes along the axis through both tubes to the needle.

BRIEF DESCRIPTION OF THE DRAWINGS

The method and system of the present invention will now be described, by way of example only, with respect to the accompanying drawings, in which.

BEST MODES FOR CARRYING OUT THE INVENTION

Figure 1:
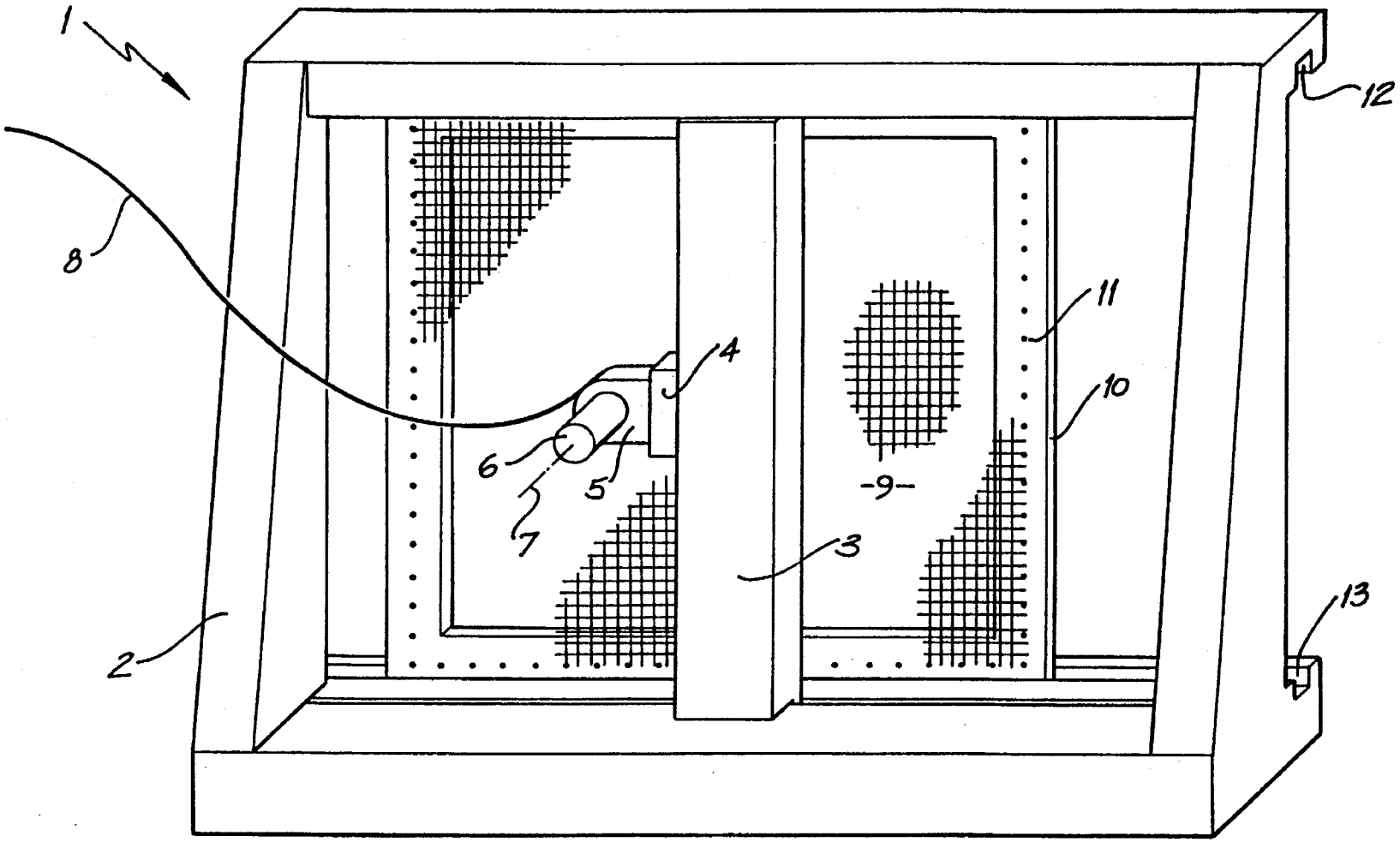
FIG. 1 is a perspective view of a system for automatically tufting fabrics embodying the present invention.

Referring now to FIG. 1, an automatic tufting machine 1 comprises an upright metal frame 2. A first carriage 3 is arranged for horizontal movement on frame 2. A second carriage 4 is arranged on the first carriage 3 for vertical movement. A mounting bracket 5 is attached to carriage 4. Taken together, carriages 3 and 4 and mounting bracket 5 comprise a traversing means in which a tufting head 6 is mounted. Tufting head 6 is mounted on a circular bearing for rotational movement about an axis 7 extending perpendicular to the horizontal and vertical directions mentioned. The tufting head is also arranged in mounting bracket 5 in a manner which permits it to advance towards the backing, and to be withdrawn from the backing, that is in the direction of axis 7. The rotational movements of the tufting head, vertical movements of carriage 4 and horizontal movements of carriage 3 are achieved by use of toothed belts which are driven by gears connected to servo motors. The advance and withdrawal of the tufting head is achieved by use of an air driven slide.

Electrical power and, if required, compressed air are supplied to tufting head 6. Yarn 8 is also supplied to the tufting head from a creel (not shown) during tufting.

In order to tuft, a backing 9 is stretched on a wooden frame 10 and secured under tension over metal hooks 11. Frame 10 is then slid into upper and lower rails, 12 and 13 respectively, on metal frame 2 where it is secured in the upright position shown.

A computer aided design system (CAD) is used to generate a design, and a computer aided manufacturing system (CAM) is used to control the tufting operation. A pattern of tufts of different coloured yarns are stored as a data file in the computer aided design system. Control signals are developed from this pattern by the computer aided manufacturing system to control the horizontal and vertical movements of carriages 3 and 4, the rotational movements of tufting head 6, the degree of advance of tufting head 6 towards the backing 9, and the reciprocating movements of a tufting needle, in tufting head 6, into and out of the backing.

When the backing has been completely tufted frame 10 is removed from frame 2 to enable the application of a latex backing to the backing, and to release tufting machine 1 for further tufting using another stretched frame 10.

During tufting, the tufting head 6 is pressed against the backing 9 at preselected pressure to cause a desired deflection of the backing, and the tip 14 (see FIG. 2*a*) of the hollow tufting needle 15 is pushed into and out of the backing as the needle is reciprocated back and forth.

The needle tip 14 follows a near sinusoidal trajectory 16 through the backing 9 as the tufting head traverses at a constant speed, and yarn is fed through the needle.

Figure 2A:
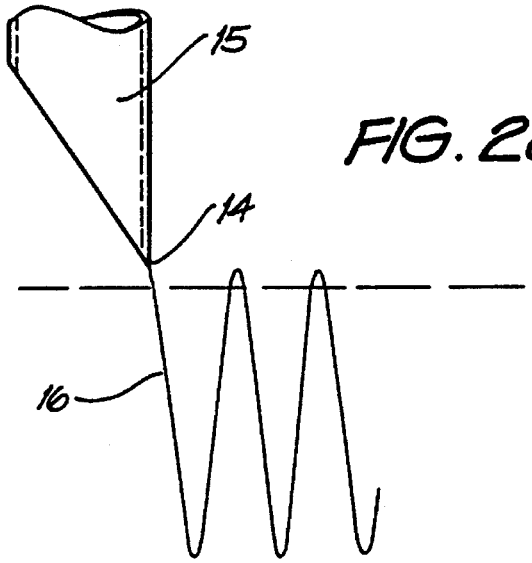
FIG. 2*a* is a schematic diagram illustrating the trajectory of a tufting needle during tufting.
Figure 2B:
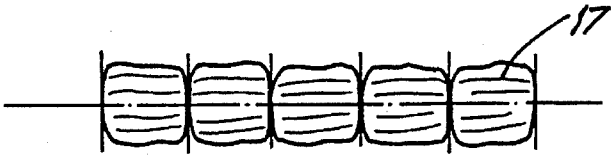
FIG. 2*b* is a plan view of a row of tufts tufted by a needle following the trajectory of FIG. 2*a*.
Figure 2C:
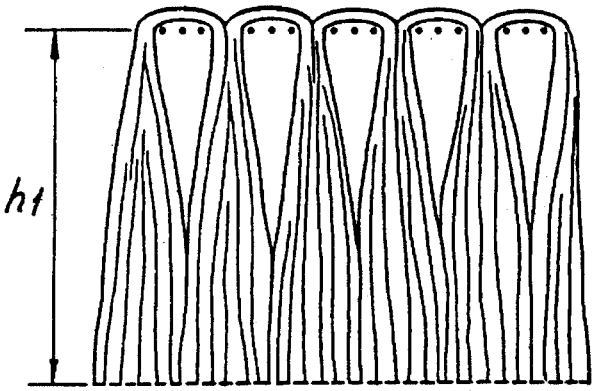
FIG. 2*c* is a cross-sectional view showing cut pile tufted by a needle following the trajectory of FIG. 2*a*.
Figure 2D:
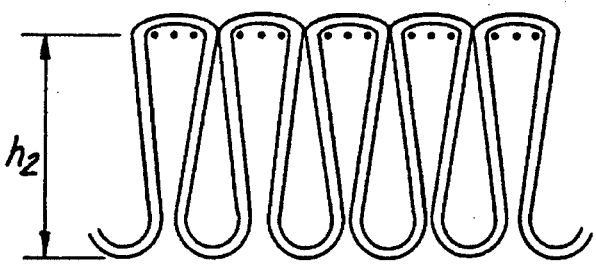
FIG. 2*d* is a cross-sectional view showing loop pile tufted by a needle following the trajectory of FIG. 2*a;*

FIG. 2*b* is a plan view of the tufts 17 produced by the needle following the trajectory shown in FIG. 2*a*. If the material is cut at the bottom of each insertion of the needle through the backing, then a cut pile of length $h_1$ is created as shown in FIG. 2*c*. Alternatively if the tufting yarn is left uncut a loop pile of length $h_2$ is created as shown in FIG. 2*d*.

There is another type of movement of the head, called a "move". In a "move" the tufting head is lifted from the backing and traversed to a new position without tufting. This facilitates accurate registration of the tufting head over the backing.

Figure 3:
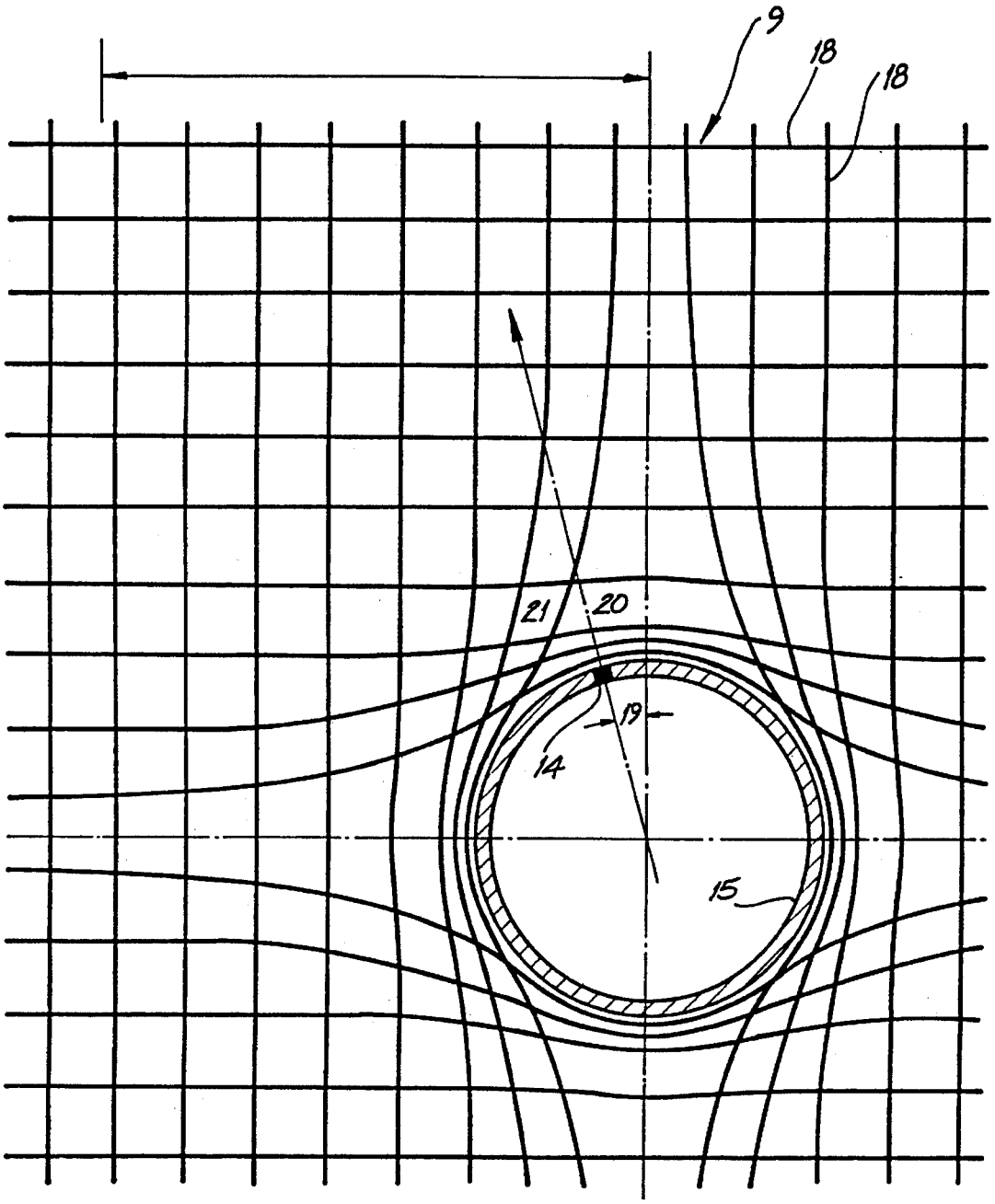
FIG. 3 is a plan view showing the distortion of the backing when a needle is inserted into it.

It has been found that, as the tufting head is traversed over the backing, the tufts are inserted with positional errors in dependence upon a number of factors and circumstances Referring now to FIG. 3 the hollow needle 15 has a relatively large diameter when compared to the mesh size of the backing 9; the diameter of needle 15 can be seen to be equal to about five times the length of the spacing between filaments 18 of the undistorted backing. When needle 15 is inserted into backing 9 the filaments are distorted as shown and the distortion can be seen to extend through about sixteen filaments in the horizontal and vertical directions.

The distortion causes no problem when the traverse is in the horizontal or vertical directions (that is the direction of the filaments) or in directions close to 45° between the horizontal and vertical, but when the direction of traverse is at other angles, for instance the angle 19 shown, the distortion causes hole 20 to be the next hole entered rather than hole 21 which is the correct hole according to the theoretical trajectory. This introduces an error into the tuft positioning in a direction which depends on the direction of traverse.

Figure 4:
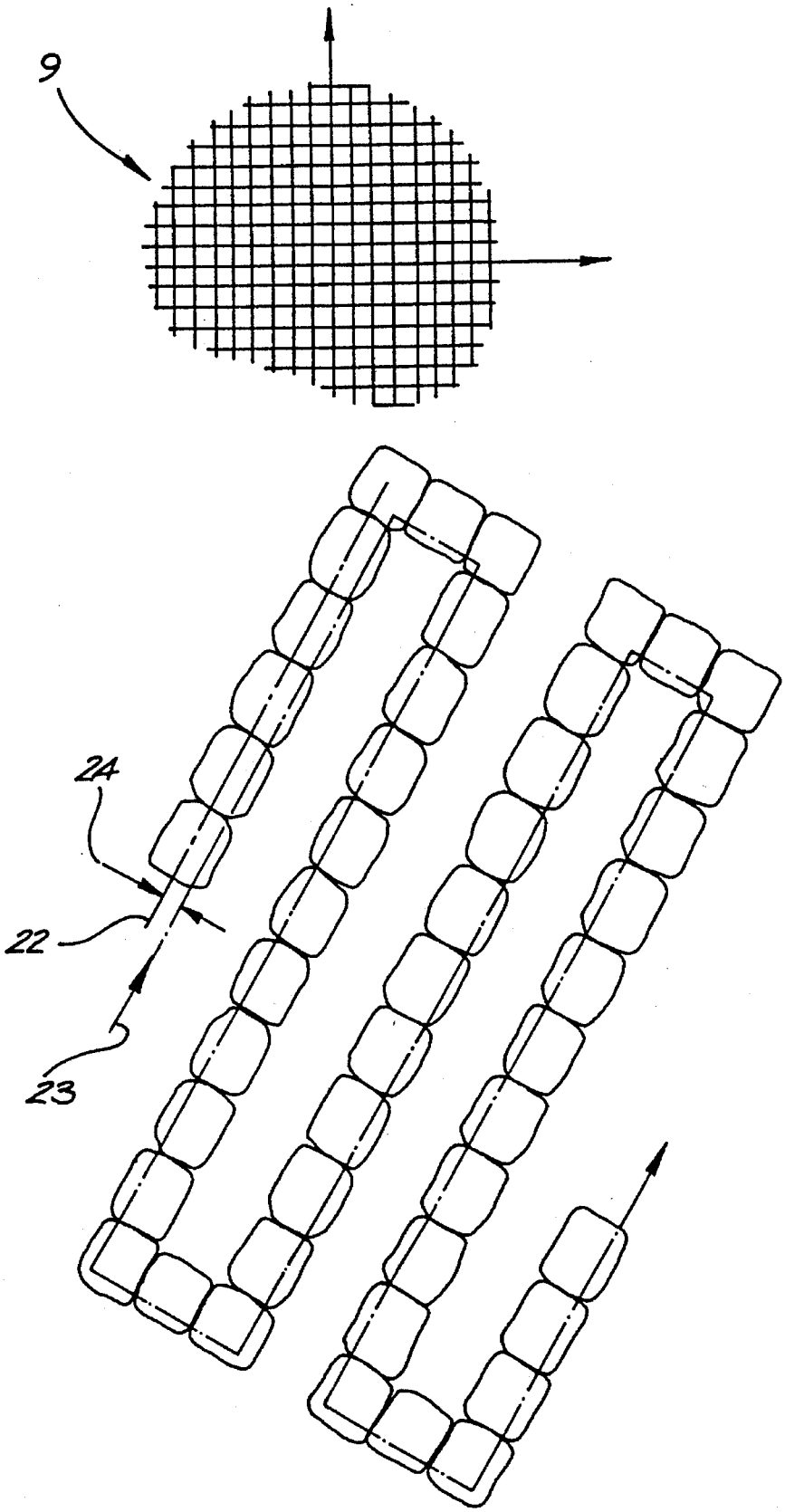
FIG. 4 is a plan view indicating the offset introduced by the distortion shown in FIG. 3.

In general the error causes the tufts to be located closer toward the respective axes than intended. The effect on rows of tufts is illustrated in FIG. 4 where the center line of the tufts 22 can be seen to be offset from the needle trajectory 23 by an offset value 24.

Another source of tuft location error has been found to arise from the fact that the center of a tuft inserted into the backing lies somewhere between the locations of the tip and the center of the tufting needle at the instant the tip first penetrates the backing to sew that tuft. This results in an error being introduced into the tuft location depending upon the rotational orientation of the needle.

The degree of error introduced by these mechanisms is dependent, to some extent, on the yarn type and thickness, the distorting effect of the large diameter needle and the backing type.

Compensation may be effected by the CAD design system, for instance by adjusting the positions of the tufts to compensate for the errors once a design has been finalised by the designer. Alternatively the CAD system may leave the design in the form finalised by the designer and compensation may be introduced by the CAM control system which reads the design and then generates control signals which are sent to the tufting head. Another option is to incorporate compensations in the tufting head mechanism itself, for instance the needle can be turned slightly to pick a different hole in the backing, or the rotational center of the head can be adjusted so that the centers of the inserted tufts coincides with the center of rotation. Another alternative would be to compensate by means of lookup tables.

Figure 5A:
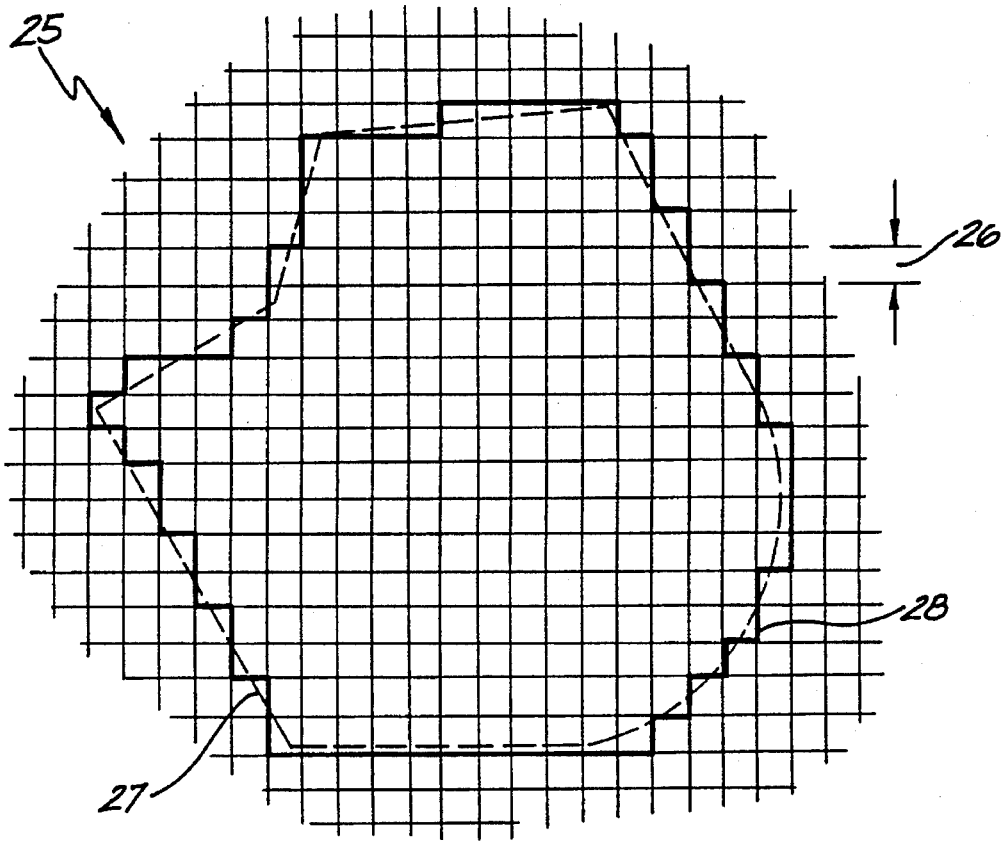
FIG. 5*a* illustrates one way in which a design shape is interpreted by the prior art.
Figure 5B:
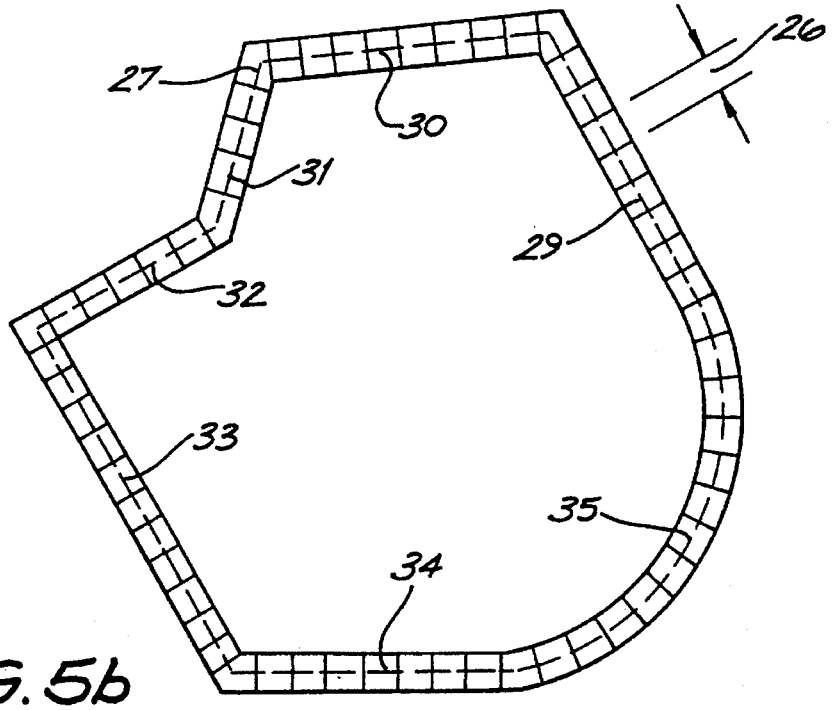
FIG. 5*b* illustrates how the same design shape is interpreted according to an embodiment of the invention.

Another problem which has been encountered is that it is difficult to produce a fine and accurate pattern from relatively large tufts. One manner of arranging and inserting the tufts is to consider a pattern to be a matrix 25 of tufts of different colours, each having a size 26 as shown in FIG. 5*a* (rather like the pixels of a picture displayed on a visual display unit). In this case to create any particular design shape 27, all the tufts of a particular colour can be inserted in either horizontal or vertical rows. In this case the resulting tufting pattern is reduced to a series of straight line segments as shown by outline 28. In addition since the position of every tuft is defined in the matrix, there is a need for a very large amount of data which makes modification of the design, such as changes in tuft lengths, very laborious and difficult. A better way of defining the pattern is to define only the beginning and end of each straight, 29 to 34, or curved, 35, line of tufts as shown in FIG. 5*b*, and to use an algorithm to calculate the position of each individual tuft between the defined ends of each line.

With this type of compression the following instruction set retract the head and move to position $x_1$, $y_1$ lower the head then sew to $x_2$, $y_2$ then retract the head and move to 0,0 can be represented in a data file as:

| X | Y | FUNCTION |
|---|---|---|
| $x_1$ | $y_1$ | MOVE |
| $x_2$ | $y_2$ | SEW |
| 0 | 0 | MOVE |

Figure 6A:
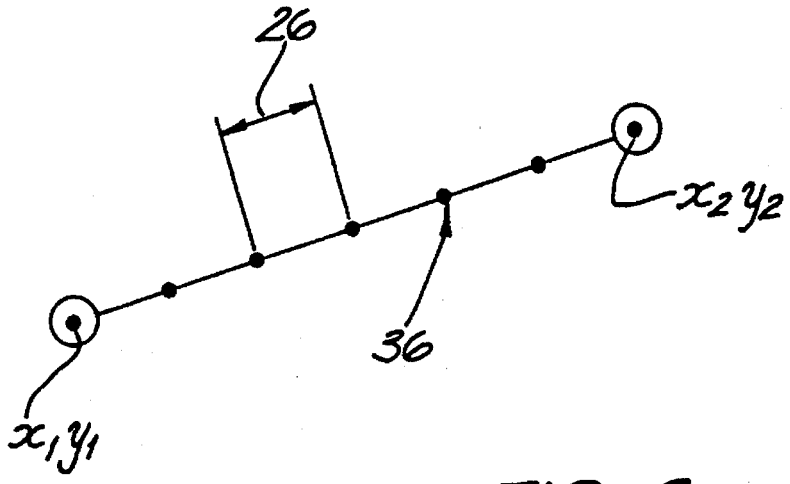
FIG. 6*a* illustrates the location of tufts along a straight line according to an embodiment of the invention.
Figure 6B:
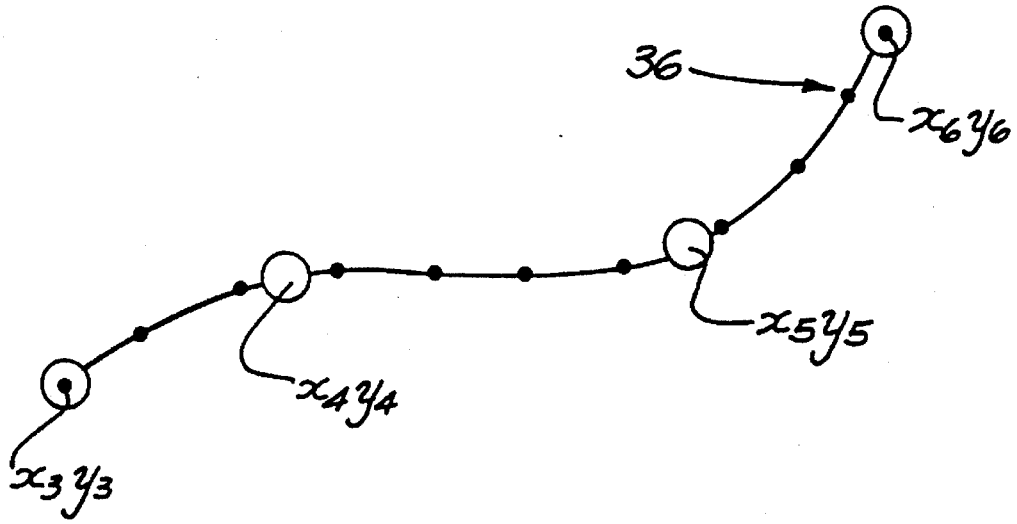
FIG. 6*b* illustrates the location of tufts along a curved line according to an embodiment of the invention.

A straight line algorithm then calculates the integer number of tufts for that line as follows:

the length of a line of tufts, from $x_1y_1$ to $x_2y_2$ is divided by the preferred stitch length to give a theoretical number of stitches, and this number is rounded to the nearest whole number. The stitch length is then adjusted within a defined tolerance range to provide an integer number of stitches along the length of the line. The positions of the resulting tufts 36 are shown in FIG. 6*a*.

Curves are defined by a series of data points $x_3y_3$, $x_4y_4$, $x_5y_5$ and $x_6y_6$ (see FIG. 5*b*) and an indication of curve type, such as polynomial, spline, bezier etc. A curved line algorithm then calculates the integer number of tufts for that curved line as before:

the length of the line, from $x_3y_3$ to $x_6y_6$ is divided by the preferred stitch lengths to give a theoretical number of stitches, and this number is rounded to the nearest whole number. The stitch length is then adjusted within a defined tolerance range to provide an integer number of stitches along the length of the line. Again the positions of the resulting tufts 36 are shown In both straight and curved lines the locations of the tufts may not coincide with the positions of each data point. This is particularly noticeable in the case of wavy lines where the curvature changes along their length, because changes in curvature are accompanied by changes in the spacing between the points defining the curve.

The rounding of the number of rows affects the density of the pile. Variations in density affect the compliance of the finished product, that is how much pressure it takes to distort the pile. In consequence differences in density effect the way the finished product feels to touch or walk on, and it also affects the way in which the pile sits, giving the finished product an inconsistent appearance. This problem may be overcome by calculating the row spacing for a given area first, and then calculating the tuft length for the rows of that area to give a density of tufts between predetermined upper and lower limits.

The order of placement of tufts is important because when an area which is surrounded by a vacant area is filled with tufts, the tufts can distort the backing and cause bulging in the edges of the tufted area which distorts the overall pattern. This can be compensated for to some extent by ensuring that two or three rows of tufts are inserted around the edge of an area which is surrounded by a vacant area, before the center is filled.

Figure 7:
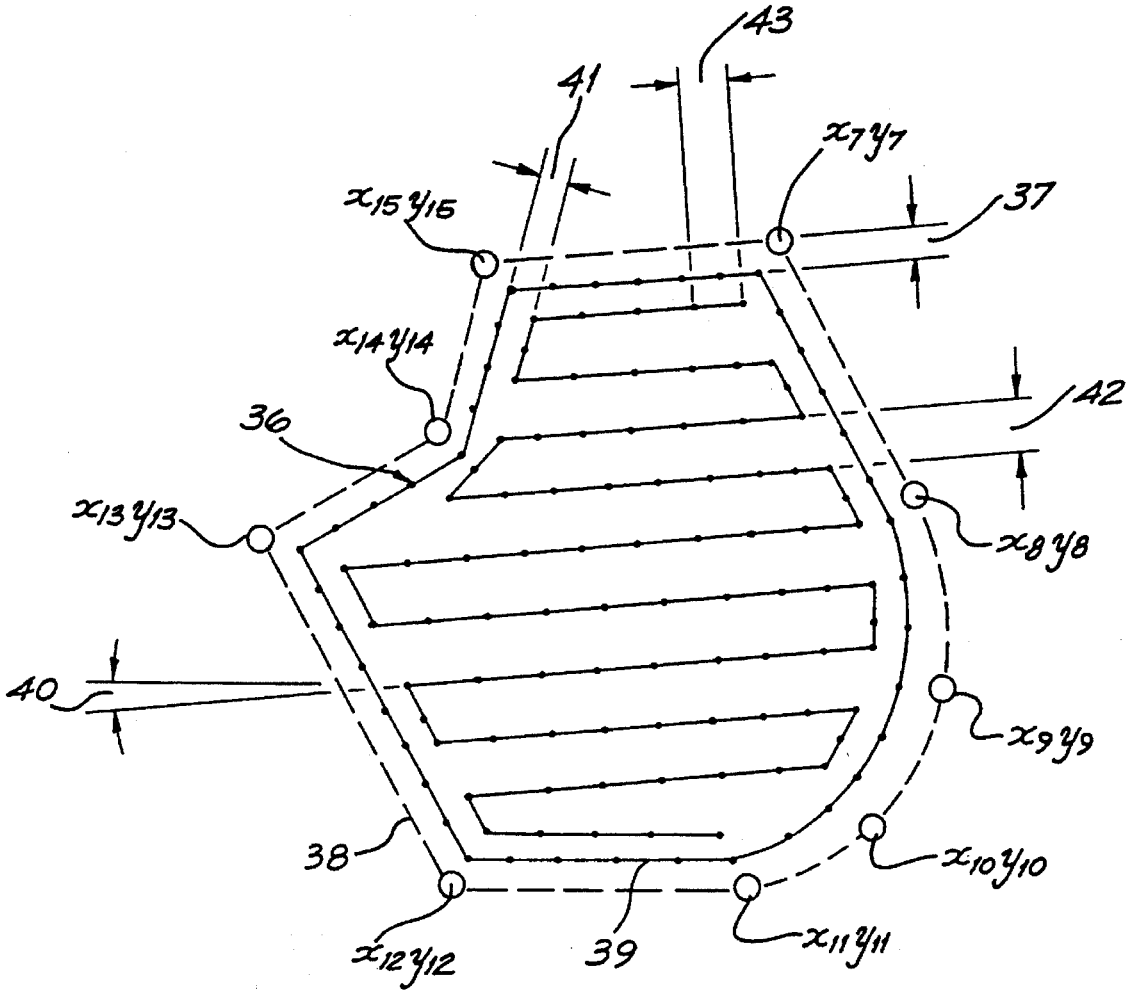
FIG. 7 illustrates the application of the principles illustrated in FIG. 6 to the design shape shown in FIG. 5.

Even better data compression can be achieved if the boundaries of each area are defined and algorithms are provided to calculate the row and stitch positions and spacings within each area. How this may be achieved will now be described with reference to FIG. 7:

An area is defined by the data points $x_7y_7$, $x_8y_8$, $x_9y_9$, $x_{10}y_{10}$, $x_{11}y_{11}$, $x_{12}y_{12}$, $x_{13}y_{13}$, $x_{14}y_{14}$, and $x_{15}y_{15}$, and a number of other parameters are provided. A first parameter, the perimeter offset 37, is used to calculate the start and end points of each line segment which together make a perimeter 38 line of tufts centered just within the perimeter of the design shape. The perimeter offset provides definition to the outline of the shape. Individual tuft positions along the perimeter line of tufts 38 are calculated for each line straight and curved line as above.

The area inside the perimeter tufting is then filled by tufting backwards and forwards along lines 39 within the area. A number of other parameters are required in order for the filling tuft positions to be calculated. These include row angle 40 and the fill offset 41. The row spacing 42 and stitch length 43 are then calculated as indicated above.

Figure 8:
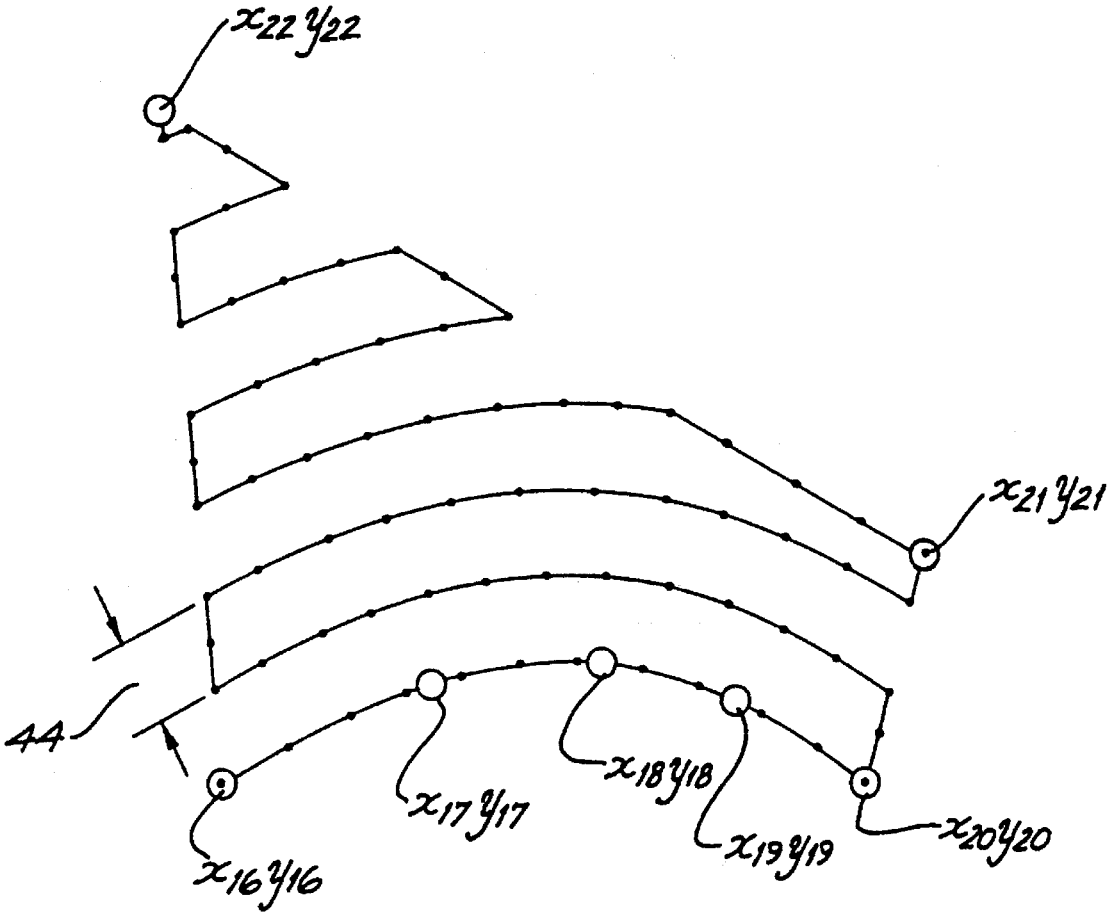
FIG. 8 illustrates the application of the principles illustrated in FIG. 6 to a different design shape.

FIG. 8 shows an alternative technique for filling an area. In this case the outline of the area is defined by data points $x_{16}y_{16}$, $x_{17}y_{17}$, $x_{18}y_{18}$, $x_{19}y_{19}$, $x_{20}y_{20}$, $x_{21}y_{21}$, and $x_{22}y_{22}$. The curve type for the curve between $x_{16}y_{16}$ and $x_{20}y_{20}$ is known, and the stitch length can be calculated for that row. Then the row spacing 44 is determined, and the stitch length for successive curved lines is calculated so that the area is filled ending at $x_{22}y_{22}$.

The feature of ensuring constant density can be very usefully employed when generating a new pattern from an old pattern. For instance where the new pattern is merely a scaled version of an old pattern, once the areas are defined the filling of each area may be automatically calculated by the algorithm which ensures constant density.

Figure 9A:
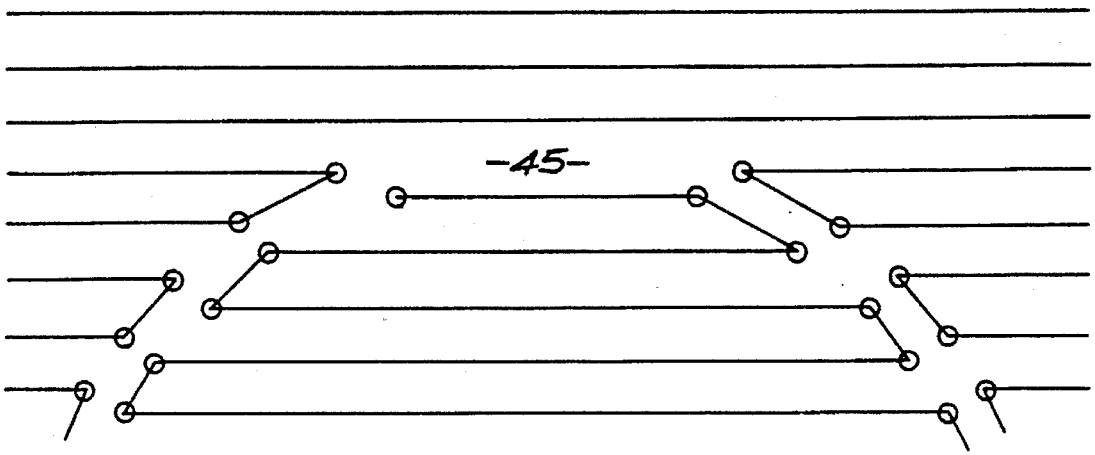
FIG. 9*a* illustrates a potential row spacing problem.
Figure 9B:
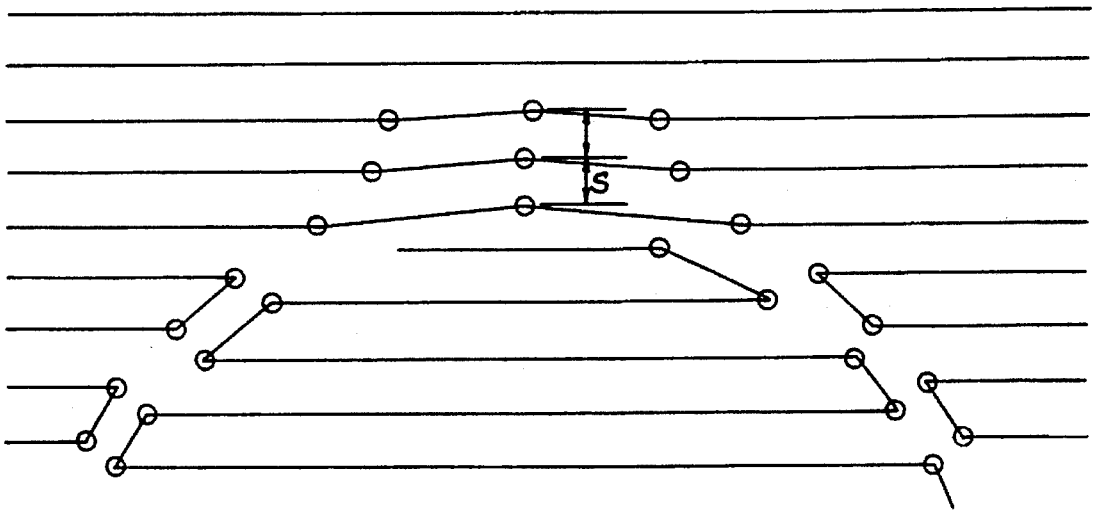
FIG. 9*b* illustrates the solution.

Another type of problem which can arise is where one area is being tufted adjacent to an area that has previously been tufted. For instance, referring to FIG. 9*a*, where all the rows in both areas are parallel, and tufting proceeds into a vacant corner bordered by the already tufted area. In this case, if the rows of tufts approaching the already tufted area are not correctly spaced with respect to the rows of the already tufted area, a gap 45 can be created between the two areas which is too narrow for an extra row; in other words the gap is less than twice the minimum row spacing allowable. This can lead to an area of low tuft density, or at worst an obvious gap in the tufts. The problem may be overcome by adjusting the spacing between the rows, within specified tolerances, in either or both of the areas, see FIG. 9*b*.

Figure 10A:
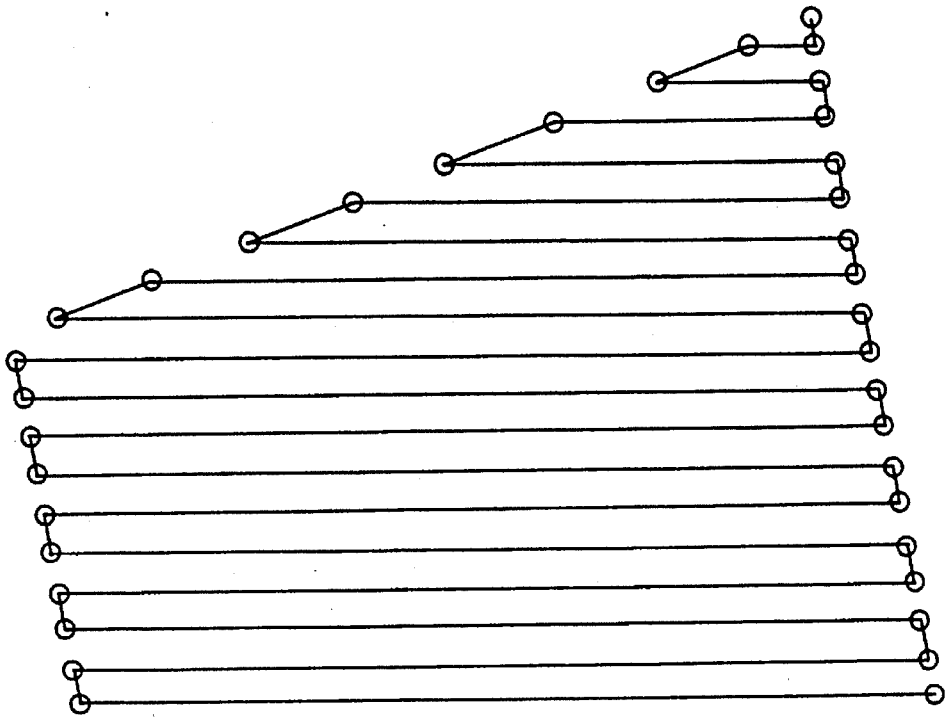
FIG. 10*a* illustrates another potential row spacing problem.
Figure 10B:
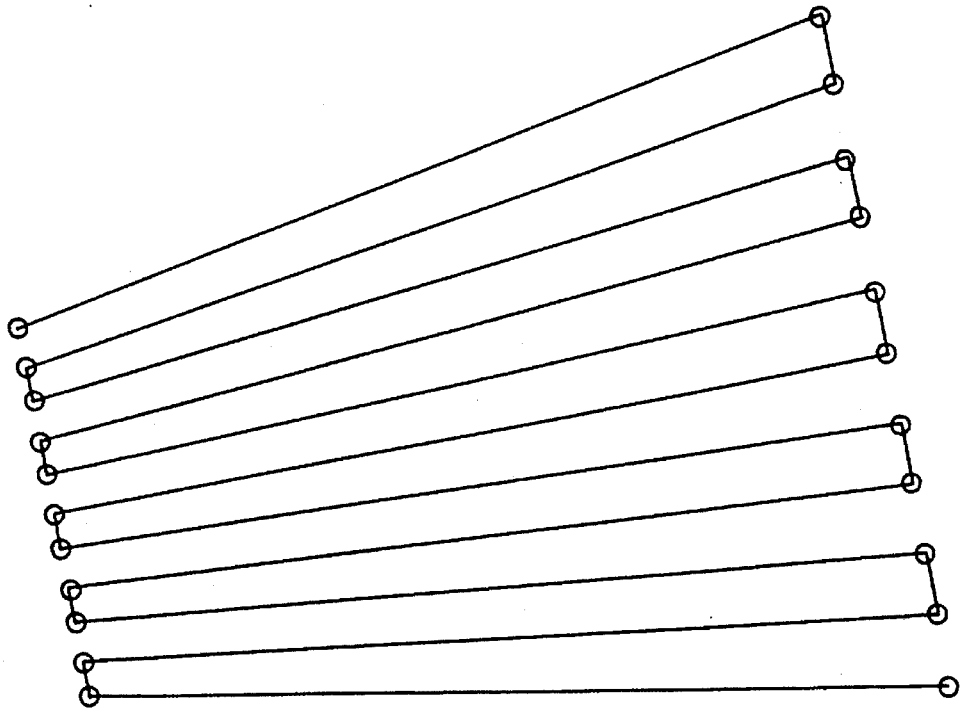
FIG. 10*b* illustrates the solution.

Another problem arises where an area having sides which are close to, but not parallel is required to be tufted. In this case if the area is tufted by tufting rows parallel to one of the sides, gaps can occur along one edge of the area where the rows meet as an angle, see FIG. 10*a*. This problem can be overcome by fanning the rows so that a tapered gap is distributed across the area to be filled, see FIG. 10*b*. This results in many small tapers between the rows, but no gaps are created and the resultant variation in density can remain undetectable providing the tolerance on row spacing is set with a suitable maximum.

Figure 11:
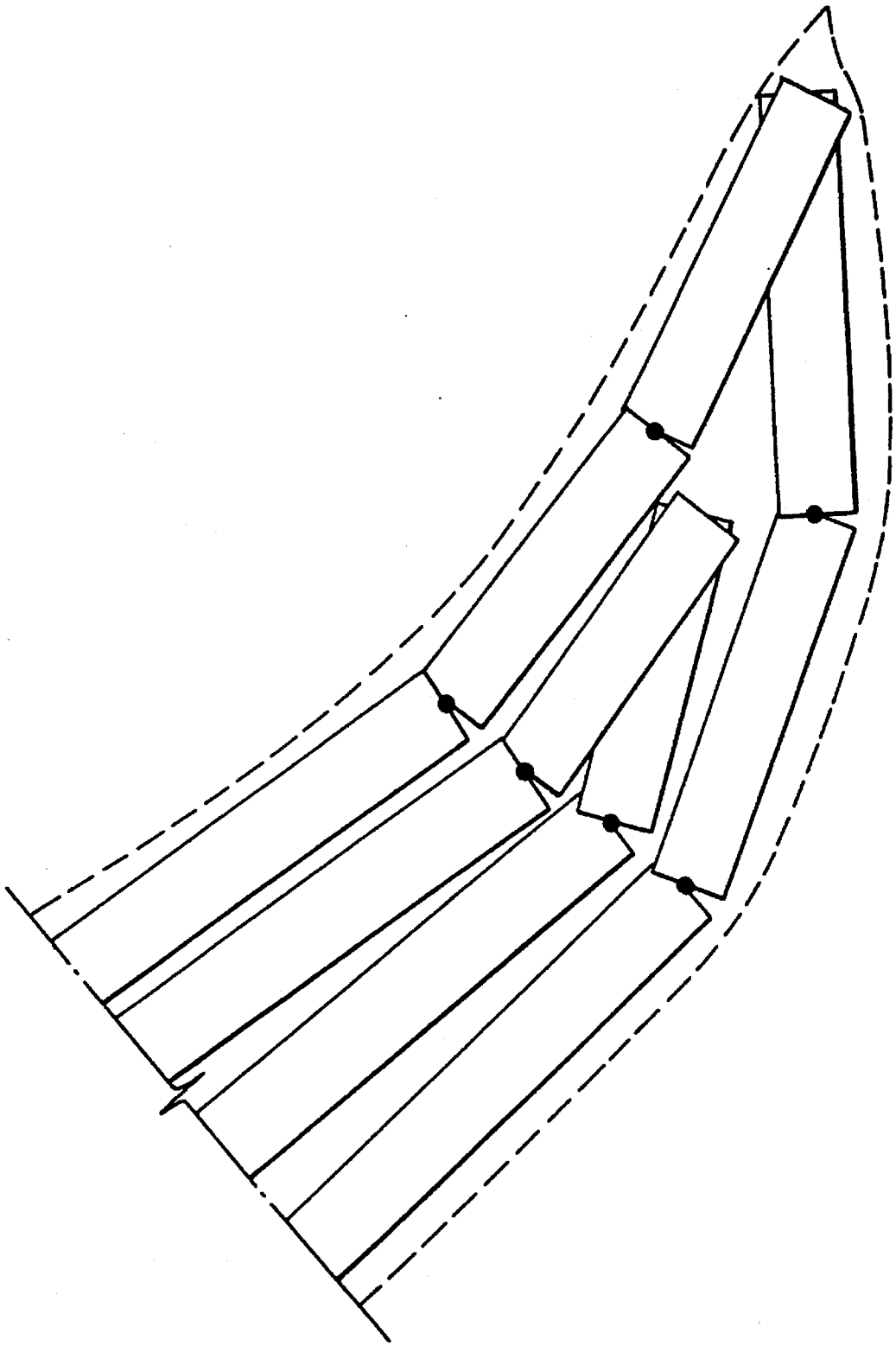
FIG. 11 is a representation of a display from a design system embodying the invention.

When a pattern is being designed, say for a rug, some areas of the pattern may have shapes which cannot easily be generated by a set of mathematical rules. In order to facilitate such design the CAD/CAM system is arranged to display the design by showing rows of tufts as broad lines having the correct scaled width, see FIG. 11. This is particularly useful where the tufts must be arranged in confined spaces because it allows the designer to ensure equal space on each side of each row thereby reducing the possibility of overtufting occurring. This also allows a curved line of tufts to be shown as a series of straight rows having the required width, extending between the data points which define the curve.

A further useful feature is to provide a zoom facility at only predetermined scaling, since this trains the designers to become accustomed to seeing the patterns always at the same series of relative sizes.

The CAD/CAM system is advantageously arranged to allow a point in a row of tufts to be moved, say by the operation of a mouse, and when a point is moved the display shows the rows of tufts extending away from that point automatically following the point by changing direction and length to accommodate the movement.

It is advantageous to include in the CAD/CAM system the ability to check the pattern by running through it, without tufting, to identify any points where lines or individual tufts either clash or become closer than a specified tolerance to each other. An operator may then make a decision as to whether correction should be introduced into the pattern.

Figure 12:
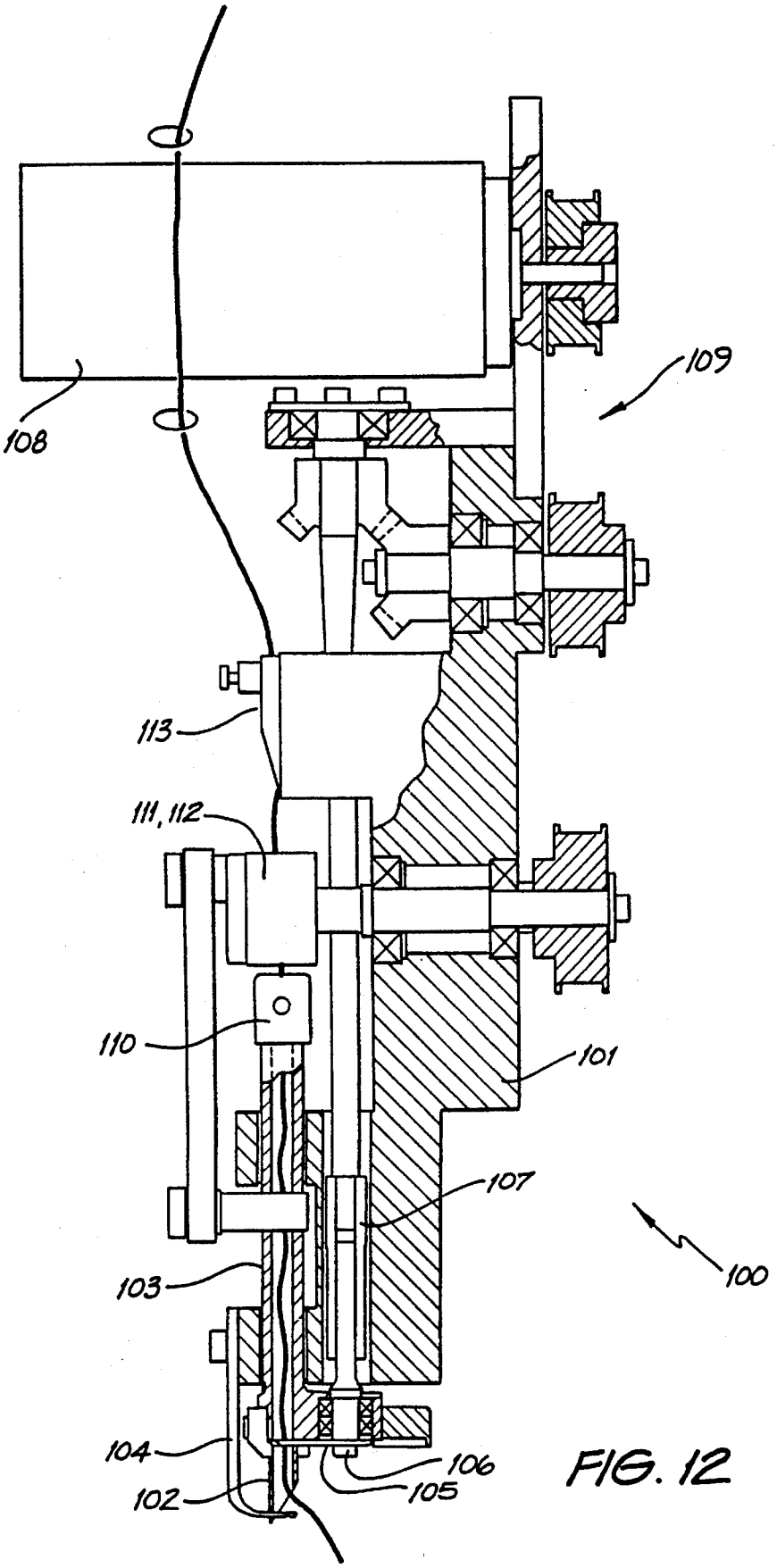
FIG. 12 is an elevational view of a tufting head embodying the present invention.
Figure 13:
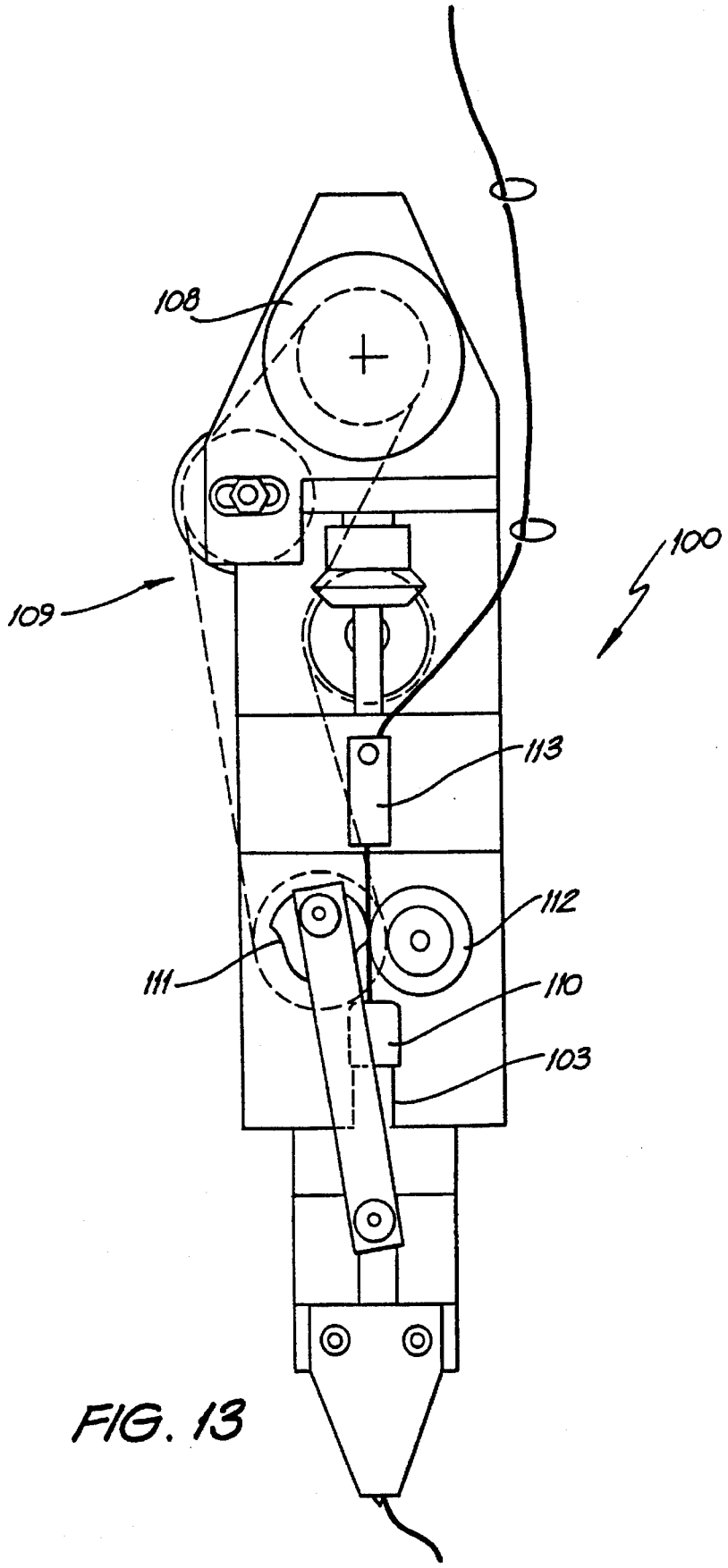
FIG. 13 is an orthogonal elevation of the head of FIG. 12.
Figure 14:
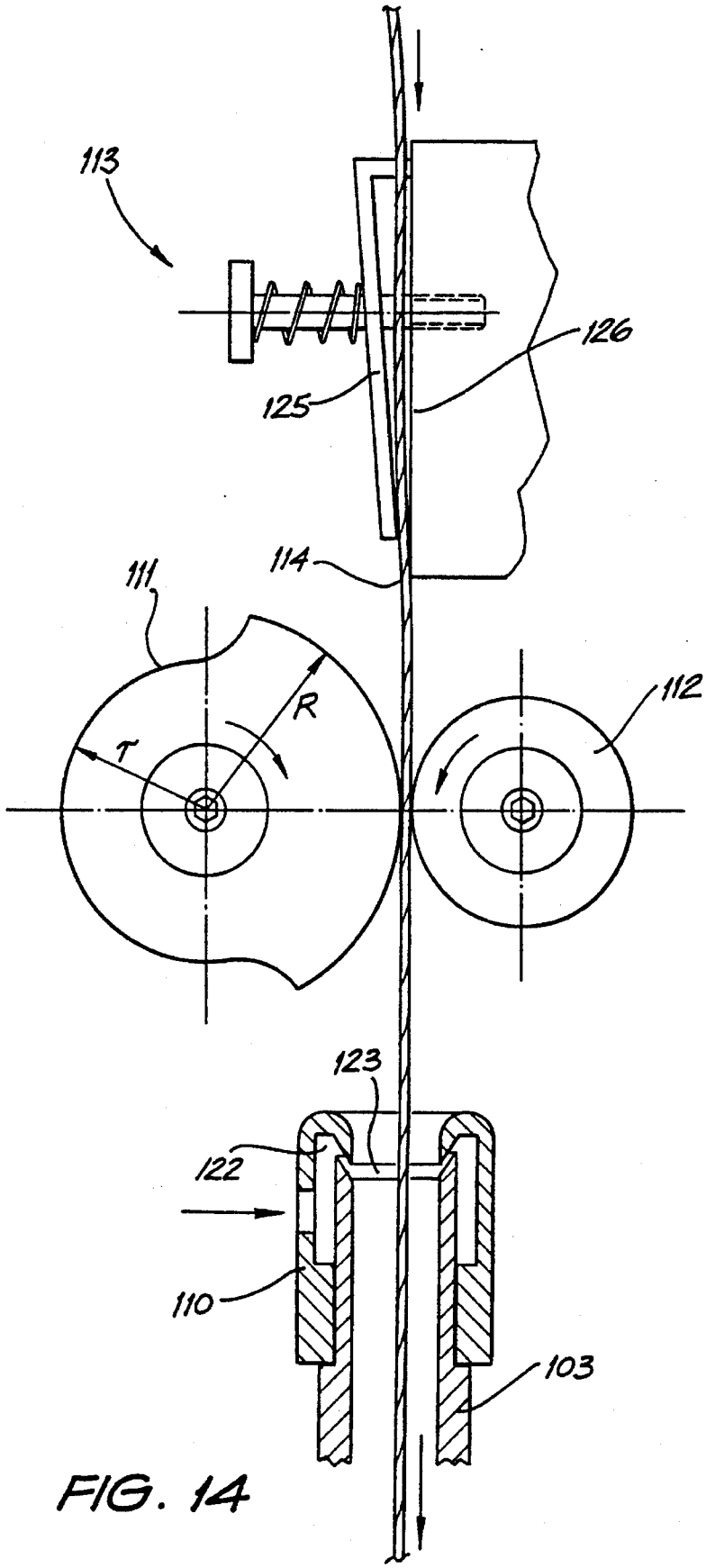
FIG. 14 is a detail from FIG. 13.

Referring now to FIGS. 12, 13 and 14, tufting head 100 comprises a base 101 to which a needle 102 and a needle barrel 103 are mounted for vertical reciprocating motion. The needle 102 and barrel 103 are hollow and there is an opening in the bottom of the needle to allow yarn to be fed out. A foot 104 is connected to base 101, and includes a hole through which the needle may reciprocate.

A blade 105 for cutting the yarn is mounted on a carrier 106 which is attached to the end of a telescopic and rotatably mounted shaft 107. The carrier 106 is also connected to the needle barrel 103.

An electric motor 108 is mounted on the head. A series of drive belts, pulleys, differential gears, connecting rods and cranks, indicated generally by 109, transfer rotating drive motion from the motor 108 into reciprocating motion of the needle barrel 103 and shaft 107, and rotating motion of blade carrier 106.

A compressed air supply is connected to a shroud 110 covering the upper end of the needle tube 103 to direct a stream of air down the hollow interior and out of the opening in the bottom of the needle.

A pair of pinch wheels 111 and 112 are employed to feed yarn into the upper end of the needle tube 103. A yarn brake 113 is provided to prevent movement of the yarn when the pinch wheels are disengaged from each other.

FIG. 14 shows a sectional detail of needle barrel 103, the air supply from shroud 110, and pinch wheels 111 and 112, together with the constant drag yarn brake 113, and a length of yarn 114. One 111, of the pair of pinch wheels 111 and 112 is driven and has a portion of its periphery at a first, greater, radius R and a portion at a second, lesser, radius r. The relative sizes of the sectors of the wheel having each radius are selected and the rotational position of the wheel is selected to enable contact between the two pinch wheels over a preselected period of time during each revolution. When the pinch wheels are in contact the yarn is gripped and driven downward. In this way the height of the tufts, and the time during which yarn is driven downward in each reciprocation of the needle can be controlled. This ensures that the yarn is only allowed to exit through the opening in the bottom of the needle when the backing filaments are fully parted.

In an alternative embodiment both pinch wheels have portions of greater and lesser radius, and their relative rotational positions determine the length of the yarn fed out and the timing relative to other operations in the tufting sequence. In this case both wheels are driven and their drive shafts are geared together. The wheels can be adjusted and reclamped on the shafts at different rotational positions relative to each other to produce different lengths of yarn, or to change the timing.

The compressed air supply to the needle will be described. The compressed air is supplied to shroud 110 covering the upper end of the needle barrel 103. The air enters an annular gallery 122 which runs around the interior of the shroud 110, and exits through an angled slit 123 which runs around the interior of the shroud 110. The slit 123 is angled to direct air downwards through the needle barrel 103. The arrangement of the slit creates a vortex which is able to suck a loose length of yarn into the upper end of the needle barrel. Once the yarn is in the barrel, it is entrained in the air stream, held straight, and directed downward through the barrel. Multiple slits may be provided in the barrel, if desired.

The air jet exiting the opening in the bottom of the needle helps to part previously sewn tufts once the needle has penetrated the backing. This assists the sewing of new tufts without obstruction. Blockages occur from time to time when filaments of the backing and previously sewn tufts obstruct the needle opening. The positioning of the shroud at the upper of the needle barrel prevents the yarn being blown back out of the barrel when a blockage occurs in the needle. This is prone to happen with prior art assemblies where the compressed air is supplied to the lower end of the needle barrel.

The yarn brake 113 is used to prevent the yarn being dragged into the needle by the air jet when the pinch wheels 111 and 112 are not engaged. It also prevents the yarn being dragged out of the head by tension from the creel as the head traverses across the surface of the backing.

The yarn brake 113 consists of a channel section spring 125 loaded against a polished face 126. The yarn can be pulled out by the pinch wheels relatively easily, but can not be pulled back towards the creel. The spring 125 can be raised from the surface of the yarn when it is necessary to pull back yarn from the needle, for instance when it is desired to change yarns.

Figure 15:
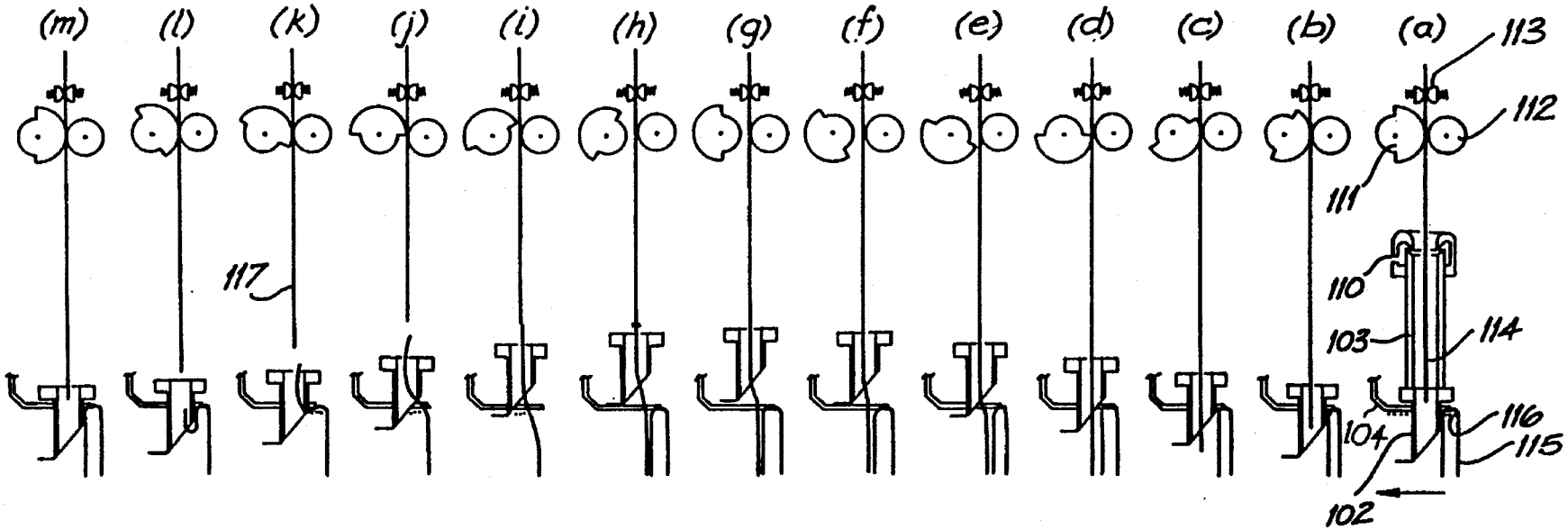
FIGS. 15*a* to *m* is a series of schematic diagrams showing the operation of the tufting head of FIGS. 12, 13 and 14 as it goes through a complete 360° reciprocation.

FIG. 15 illustrates the features of FIG. 14 together with a sectional view of needle 102 and foot 104 as they move through a cycle of operation. At bottom dead center, in FIG. 15(*a*), a stitch 115 has just been located in the backing 116, and the needle is about to begin its upward stroke. At this point in time the pinch wheels 111 and 112 are pulling a length of yarn 114 through the yarn brake 113 and the air supply in shroud 110 is ON entraining the yarn neatly down the interior of the needle barrel 103.

Later at (b), the needle 102 has risen and simultaneously the length of yarn 114 has been drawn down.

At (c), the needle 102 has risen further and the length of yarn 114 has been driven down further. Shortly after, the needle opening begins to be obstructed by the filaments of the backing closing across its upper edge.

At (d), the length of yarn 114 has reached its lowermost position and the pinch wheels release the yarn. The first tuft of the stitch is now in place.

The tip of the needle is subsequently drawn clear of the backing and the air supply is then turned OFF.

Just before (g), the rotating blade 105 begin to enter the needle barrel and at (h), when the needle 102 has just passed top dead center the length of yarn 114 is cut.

The tip of the needle enters the backing and at (i) the blade clears the tube.

At (j), the yarn begins feeding again as the descent of the needle 102 pulls the upper end of the cut length of yarn 114 downwards.

Just before (k), the needle opening fully clears the filaments of the backing and the air supply is switched ON again to hold the new length of yarn 117 straight. As the needle descends further the upper end of the cut length of yarn 114 is pulled down through the backing by the upper edge of the needle opening until, at bottom dead center the second tuft of the stitch is fully located in the backing, and the stitch is complete.

The thin flexible blade 105 is mounted on the blade carrier 106 to enter a transverse slot in the needle barrel 103 and to be drawn across the polished face of an anvil. Both the face of the anvil and the edge of the blade are angled to reduce the contact area and increase the pressure at the instant of cutting. This reduces friction wear and heat generation.

The intermittent yarn drive results in the yarn being held stationary at the time the blade 105 is cutting. The needle 102 on the other hand is at this time moving towards the backing. This means that the yarn is pulling the blade back against the anvil during the cutting operation, and as a consequence minimal blade preload is required against the anvil. The timing of the cut can be adjusted to cause the leading and trailing ends of each length of yarn to be varied every time the stitch length is changed.

A semi-automatic yarn changer may be incorporated into the head. Such a yarn changer includes a barrel having a narrow end adjacent the pinch wheels 111 and 112, and a wide distal end. At least two annular air galleries with air outlet slits are provided near the distal end of the yarn changer. A first to generate a stream of air downward through the changer and to entrain a loose end of yarn and feed it down through the barrel to the yarn pinch wheels. And a second to eject a length of yarn from the barrel.

In operation, to change yarn the head is moved to the position in its cycle where the blade 105 is clear of the barrel, the needle air stream is OFF, and the pinch wheels are apart. The yarn brake is disengaged and the second air stream turned ON to cause a stream of air to flow up the barrel of the yarn changer and eject the length of yarn in the head. Then the second air stream is turned OFF, the first air stream and the needle air stream turned ON, and the end of a new length of yarn is brought near the distal end. The new end is captured by a vortex created by the first air stream and fed down the barrel so it is eventually entrained by the needle air stream. The yarn brake is then lowered and the head is thereafter able to continue its cycle.

Figure 16:
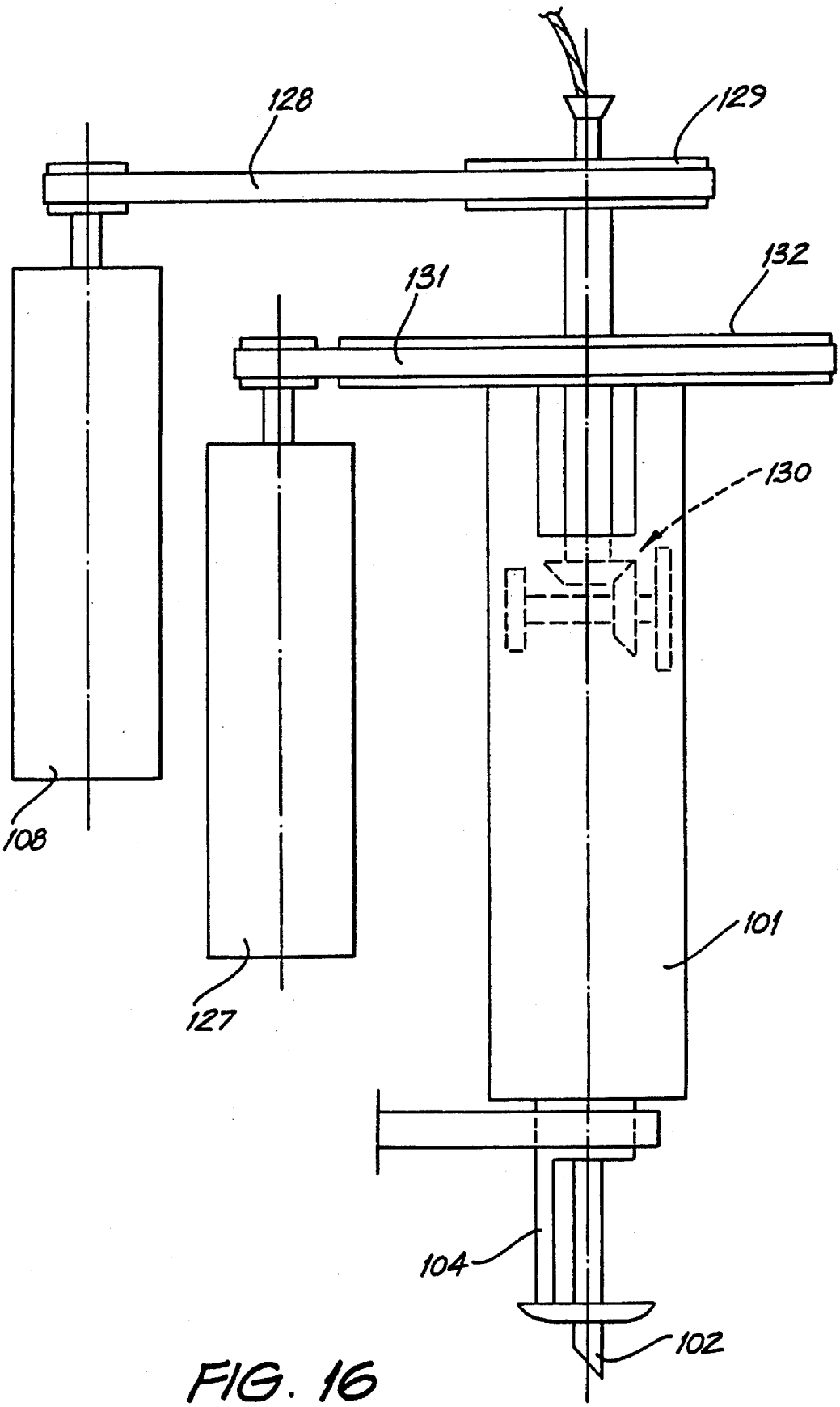
FIG. 16 is a schematic diagram illustrating an alternative tufting head embodying the present invention.

In FIG. 16 an embodiment of the tufting head will be described in which both the tufting drive motor 108 and the motor 127 for providing rotational movement of the tufting head are mounted on a part of the tufting head which does not rotate. Drive from the tufting drive motor is supplied to the rotating part of the tufting head by means of a toothed belt 128 which turns a first drive wheel 129 which in turn drives differential gears, and a connecting rod and crank, indicated generally by 130 in order to transfer reciprocating motion to the needle 102.

Rotational drive is applied to the tufting head from motor 127 by toothed belt 131 which turns a second drive wheel 132 which is directly coupled to the rotatable part of the tufting head.

At the end of each row of tufts, the needle rotation motor 127 is driven to its new position so that the needle is facing inn the correct direction for the next row of tufts. Since this motion would cause movement of toothed belt 128 supplying drive to the tufting head, drive motor 108 is arranged to be driven to a compensating amount in order to ensure the needle remains at the correct part of its cycle.

Figure 17:
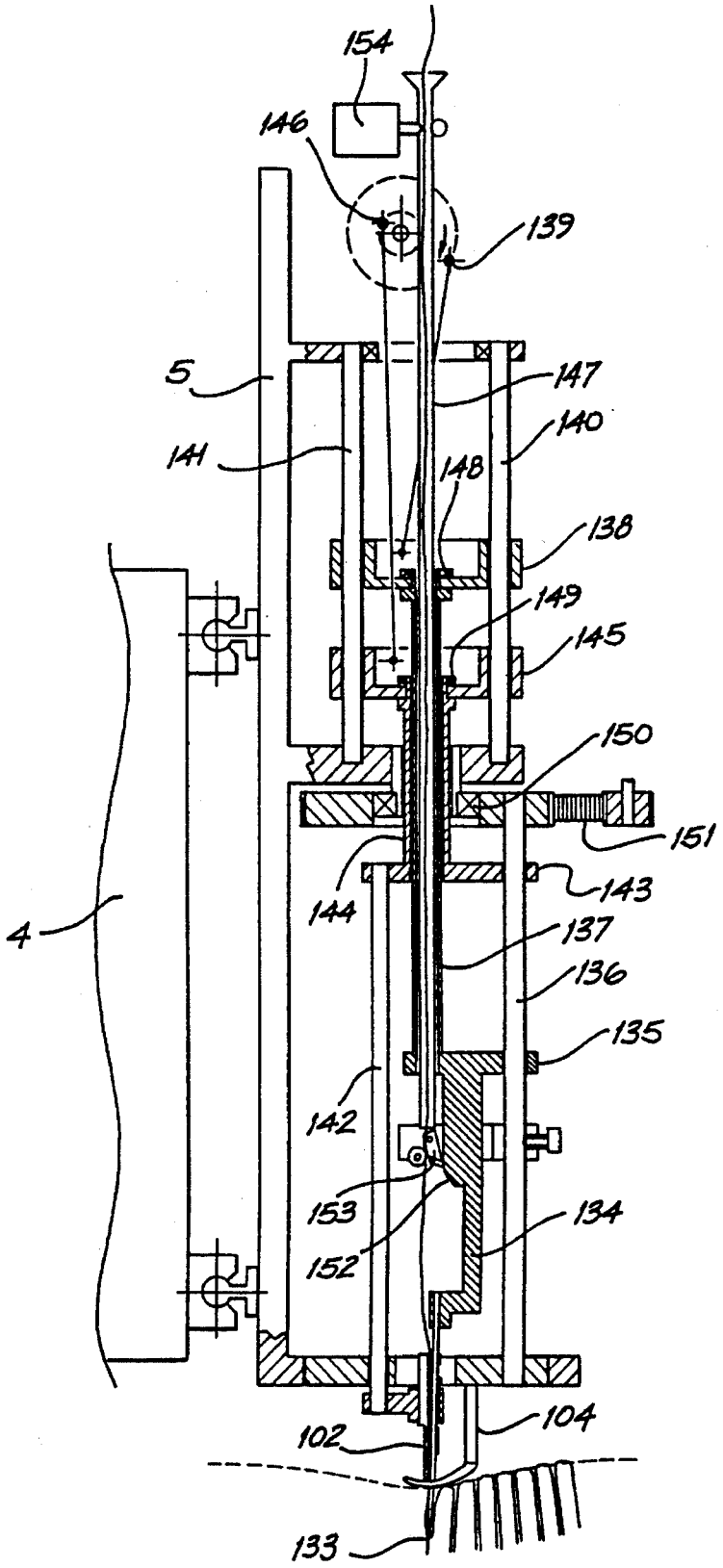
FIG. 17 is an elevational view of another tufting head embodying the present invention.
Figure 18:
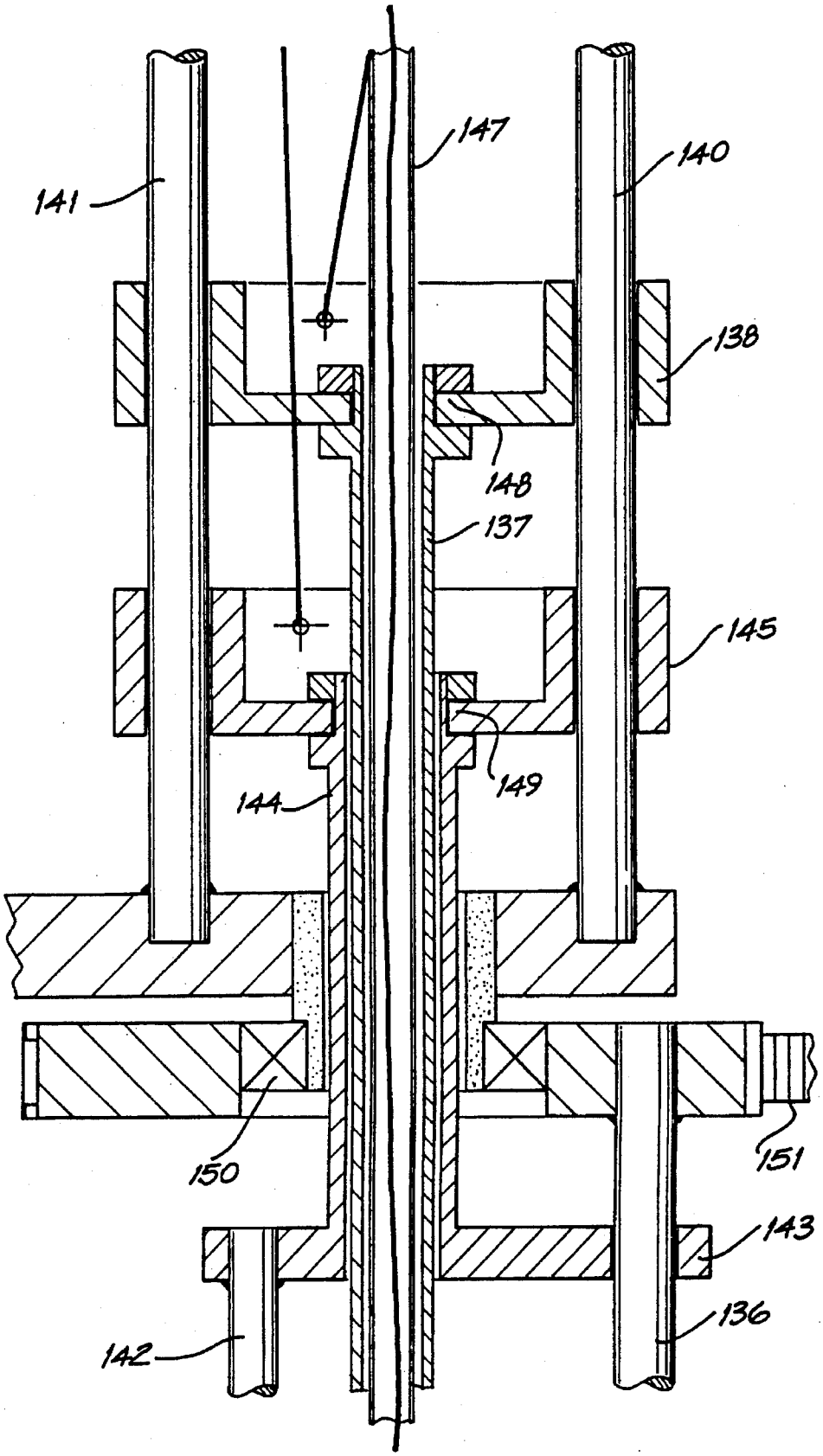
FIG. 18 is a detail from FIG. 16.

A purely mechanical tufting head will now be described with reference to FIG. 17 and 18. A forked rod 133 is reciprocally mounted within hollow needle 102, which is usually of U-shaped cross-section rather than being tubular, and the yarn is located in the fork at the end of rod 133. Rod 133 is mounted on a slidable carriage 134 for reciprocal motion guided by a slide 135 which runs along guide rod 136. A first tube 137 extends up from carriage 134 to a second slide 138 and this slide is driven up and down by an eccentric drive 139 from a rotational drive input. Second slide 138 is guided in its up and down movement by guide rods 140 and 141.

The needle 102 is driven up and down in a reciprocating motion by a connecting rod 142 which is connected to a third slide 143 which also rides up and down along guide rod 136. A second tube 144 extends upwards from slide 143 to a fourth slide 145 which is driven up and down by eccentric 146 driven by the same rotational drive as eccentric 139, but 180° out of phase with it. Slide 145 is also guided in its up and down movement by guide rods 140 and 141. Both first tube 137 and second tube 144 are hollow and coaxial, with first tube 137 extending within second tube 144.

The yarn is supplied through the hollow interior of yarn tube 147 which extends coaxially in a straight line through the hollow interior of first tube 137.

Tubes 137 and 144 are rotatably retained in their respective upper slides 138 and 145 by respective rotational bearings 148 and 149, and guide rod 136 is rotatable with respect to guide rods 140 and 141 about a vertical axis by means of rotational bearing 150. A detailed view of the arrangement is shown in FIG. 18. Rotational drive is supplied to guide rod 136 by means of toothed belt 151 to rotate it and slides 135 and 143 in order to turn the needle 102, foot 104 and forked rod 133 with respect to the remainder of the head, while at the same time reciprocating up and down motion is supplied. Yarn tube 147 does not rotate and keeps the yarn straight and free from twists.

A camming surface 152 on carriage 134 operates a lever 153 to brake the yarn, if required, at the correct point in every cycle so that the forked rod 133 can cut the yarn to make cut pile. A solenoid operated yarn break 154 is used at the end of a section of loop pile; when a loop pile is being made the cam brake is disabled, and a blunt forked rod 133 is usually employed in order to prevent the yarn being damaged at any point in the cycle.

With the purely mechanical type of head overtufting can be achieved so that, for instance, a carpet can be embroidered with a customised design.

It should be appreciated that, although the invention has been described with reference to particular embodiments it could be embodied in other forms.

What is claimed is:

1. A method of automatically tufting fabrics, comprising the steps of:

(a) stretching a backing fabric consisting of a plurality of filaments over a frame so that the filaments form a grid network with the filaments extending in at least two directions;

(b) traversing a tufting head over the backing under the influence of control signals, and reciprocating a needle in the tufting head into and out of the backing at a rate related to a speed of traverse of the tufting head, to insert tufts of yarn into positions in the grid network of the backing in accordance with a preselected pattern of tufts;

(c) determining a distorting effect the needle has on the grid network when inserted into the backing, and (d) adjusting actual positions of the needle on the grid network relative to the positions of the tufts in the preselected pattern, to compensate for positional errors introduced by the distorting effect the needle has on the grid network.

2. A method of automatically tufting fabrics according to claim 1, wherein the step of adjusting comprises at least one of varying the locations of the tufts in the predetermined pattern, varying the control signals, and mechanically compensating the traversing and tufting head mechanisms.

3. A method of automatically tufting fabrics according to claim 1, further comprising a step of adjusting the actual positions of the needle relative to the positions of the tufts in the pattern, in dependence on the distance between the position of a tuft center, and where the needle tip begins to enter the backing in order to sew that tuft.

4. A method of automatically tufting fabrics according to claim 1, in which the predetermined pattern is defined by vectors which represent at least one of the length and direction of each row of tufts, and the shape and size of each area of tufts.

5. A method of automatically tufting fabrics according to claim 1, comprising the step of calculating an integral number of tufts along the length of a line of tufts, which may be curved, from its beginning to its end.

6. A method of automatically tufting fabrics according to claim 1, comprising the step of calculating an integral number of lines across any area Of the backing.

7. A method of automatically tufting fabrics according to claim 1, comprising the step of varying the spacing between lines on either side of and parallel to a boundary between two areas of the backing, within predetermined tolerances, in order to maintain row spacing at the boundary within the predetermined tolerances.

8. A method of automatically tufting fabrics according to claim 1 comprising, where an area of the backing has two tapering boundaries, the step of tufting rows in a tapered formation between the two boundaries to share an equal proportion of the taper between each adjacent pair of rows.

9. A method of automatically tufting fabrics according to claim 1, comprising the steps of calculating an integral number of tufts along any given row in dependence on a spacing between that row and immediate adjacent rows in order to ensure that a tuft density remains within predetermined upper and lower limits.

10. A method of automatically tufting fabrics according to claim 1, comprising the step of displaying the pattern as a diagram showing arranged rows of tufts, wherein the displayed pattern shows the tufts with their widths in scale with their lengths.

11. A method of automatically tufting fabrics according to claim 1, comprising the step of checking the pattern for any occurrences of localised tuft density falling outside predetermined upper and lower limits.

12. A method of automatically tufting fabrics according to 1, comprising the step of pressing the tufting head against the backing during tufting at a preselected pressure to cause a desired deflection of the backing.

13. A method of automatically tufting fabrics according to claim 1, including the step of mounting the frame onto a machine which includes means for traversing the tufting head over the backing, before tufting, and dismounting the frame from the machine once tufting has been completed.

14. A system for automatically tufting fabrics, comprising:

(a) a frame over which, in use, a backing fabric consisting of a plurality of filaments is attached so that the filaments form a grid network with the filaments extending in at least two directions;

(b) traversing means to traverse a tufting head over the backing under influence of control signals;

(c) a tufting head mounted in the traversing means and having a tufting needle able to reciprocate into and out of the backing, at a rate related to a speed of traverse of the tufting head, to insert tufts of yarn into positions in the grid network of the backing in accordance with a preselected pattern of tufts;

(d) means for determining a distorting effect the needle has on the grid network when inserting into the backing; and (e) adjusting means to adjust the actual positions of the needle on the grid network relative to the positions of the tufts in the predetermined pattern to compensate for positional errors introduced by the distorting effect.

15. A system according to claim 14, wherein the adjusting means comprises at least one of the following: a design means to vary the location of the tufts in the pattern, a control means to vary the control signals, and means for mechanically compensating the traversing means and tufting head.

16. A system according to claim 14, wherein the adjusting means comprises a design means to vary the location of the tufts in the pattern, the design means adapted to define the pattern by a series of vectors which represent either one of the length and direction of each row of tufts, and the shape and size of each area of tufts.

17. A system according to claim 14, further comprising means to calculate an integral number of stitches along a length of a line of tufts, which may be curved, from its beginning to its end.

18. A system according to claim 14, further comprising means to calculate an integral number of lines across any area of the backing.

19. A system according to claim 14, further comprising means to vary a spacing between lines on either side of and parallel to a boundary, between two areas of the backing, within predetermined tolerances, in order to ensure that line spacing at the boundary remains within the predetermined tolerances.

20. A system according to claim 14, further comprising means to enable rows to be tufted between tapering boundaries of an area of the backing in a tapered formation so that an equal proportion of the taper between the two boundaries is shared between each pair of rows.

21. A system according to claim 14, further comprising means to calculate an integer number of tufts along any given row in dependence on a spacing between that row and its immediate adjacent rows in order to ensure that tuft density does not fall outside predetermined upper and lower limits.

22. A system according to claim 15, wherein the design means includes display means to display the pattern showing each row of tufts with their widths in scale with their lengths.

23. A system according to claim 14, further comprising means for checking the pattern for any occurrences of localized tuft density falling outside predetermined upper and lower limits.

24. A system according to claim 14, further comprising means for enabling the traversing means and tufting head to cooperate so that the tufting head can be pushed against the backing such as to cause any desired deflection of the backing.

25. A system according to claim 14, wherein the traversing means comprises a further frame on which the frame holding the backing is mounted before tufting, and demounted once tufting has been completed.

26. A system according to claim 14, wherein the tufting head comprises:

a yarn feed mechanism which engages a yarn to be tufted, in each reciprocation of the needle, to feed the yarn to the needle as the needle descends after a tip of the needle has entered the backing but before a needle opening is completely clear of the backing, and disengages to stop feeding before the tip of the needle is clear of the backing;

an air feeder to pump a stream of air through the needle and entrain the yarn, and feed it through the needle; and a yarn brake provided upstream of the yarn feed mechanism to prevent advance of the yarn when the feed mechanism is disengaged; wherein the yarn feed mechanism comprises a pair of pinch wheels, at least one of which is driven in rotation and has a portion of its periphery arranged to engage the other wheel as it rotates, and a portion of its periphery arranged not to engage the other wheel as it rotates.

27. A system including a tufting head according to 26, further including a yarn change device comprising a tube having a relatively narrow opening adjacent the yarn feed mechanism, and a relatively wide opening at its distal end, and air feed means selectively operable to direct a-stream of air either from the wide to the narrow end of the tube to entrain yarn and feed it to the yarn feed mechanism, or from the relatively narrow to the wide end to eject yarn from the tufting head.

28. A system according to claim 14, wherein a reciprocating drive motor to drive the needle in reciprocation, and a rotational drive motor to rotate the needle about an axis are both mounted on a non-rotatable part of the traversing means and supply drive to a rotatable part of the tufting head respectively by means of a first drive wheel and a second drive wheel which are both mounted on the rotatable parts to be driven in rotation about the axis; and wherein in use, rotational drive of the first drive wheel is translated into reciprocating motion of the needle and rotational drive of the second drive wheel directly causes rotation of the needle about the axis.

29. A system according to claim 14, wherein the tufting head comprises a forked blade mounted within the needle for reciprocating motion, out of phase with the needle to locate the yarn in the backing;

wherein both the needle and the forked blade are attached to respective tubes, both coaxial with an axis about which the needle is rotatable, both rotatable about that axis, and both attached at their upper ends by means of rotatable couplings to respective carriages which are not rotatable about that axis but which are both drivable in reciprocating motion to supply the reciprocating motion to the needle and blade.

30. A system according to claim 29, wherein the yarn is fed through a tube which is not rotatable about the axis, and which passes along the axis through-both tubes to the needle.

31. A method of automatically tufting fabrics according to claim 1, comprising the step of determining at least one of the following factors:

a direction of traverse of the tufting head with respect to the filaments;

any change in the direction of traverse;

the type of yarn and its thickness;

a rotational orientation of a pointed lower end of the needle with respect to the filaments;

the backing; and adjusting the actual position of the needle on the grid network relative to the positions of the tufts in the preselected pattern to compensate for any positional errors introduced by the above factors.

32. A method of automatically tufting fabrics, comprising the steps of:

(a) stretching a backing fabric over a frame to form a grid network of filaments extending in at least two directions;

(b) traversing a tufting head over the backing under the influence of control signals, and reciprocating a needle in the tufting head into and out of the backing at a rate related to a speed of traverse of the tufting head, to insert tufts of yarn into the backing in accordance with a preselected pattern of tufts;

(c) determining at least one of the following factors:

a direction of traverse of the tufting head with respect to the filaments, any change in the direction of traverse, the yarn type and thickness, a rotational orientation of a tip of the needle with respect to the filaments, a distorting effect the needle has on the grid network of filaments when inserted into the backing, and the backing;

(d) adjusting the positions of the needle on the grid network relative to the positions of the tufts in the preselected pattern to compensate for positional errors introduced by the factors determined in (c); and (e) adjusting the positions of the needle on the grid network relative to the positions of the tufts in the pattern, in dependence of the distance between the position of a tuft center and the position where the needle tip begins to enter the backing in order to sew that tuft.

33. A method of automatically tufting fabrics, comprising the steps of:

(a) stretching a backing fabric over a frame to form a grid network of filaments extending in at least two directions;

(b) traversing a tufting head over the backing under the influence of control signals, and reciprocating a needle in the tufting head into and out of the backing at a rate related to a speed of traverse of the tufting head to insert tufts of yarn into the backing in accordance with a preselected pattern of tufts;

(c) determining at least one of the following factors:

a direction of traverse of the tufting head with respect to the filaments, any change in the direction of traverse, the yarn type and thickness, a rotational orientation of a tip of the needle with respect to the filaments, a distorting effect the needle has on the grid network of filaments when inserting into the backing, and the backing;

(d) adjusting the positions of the needle on the grid network relative to the positions of the tufts in the preselected pattern to compensate for positional errors introduced by the factors determined in (c); and (e) varying the spacing between lines on either side of and parallel to a boundary between two areas of the backing within predetermined tolerances, in order to maintain row spacing at the boundary within the predetermined tolerances.

34. A method of automatically tufting fabrics comprising the steps of:

(a) stretching a backing fabric over a frame to form a grid network of filaments extending in at least two directions;

(b) traversing a tufting head over the backing under the influence of control signals, and reciprocating a needle in the tufting head into and out of the backing at a rate related to a speed of traverse of the tufting head, to insert tufts of yarn into the backing in accordance with a preselected pattern of tufts to form a tufted fabric;

(c) determining at least one of the following factors:

a direction of traverse of the tufting head with respect to the filaments, any change in the direction of traverse, the yarn type and thickness, a rotational orientation of a tip of the needle with respect to the filaments, a distorting effect the needle has on the grid network of filaments when inserted into the backing, and the backing;

(d) adjusting the positions of the needle on the grid network relative to the positions of the tufts in the preselected pattern to compensate for positional errors introduced by the factors determined in (c); and (e) where an area of the tufted fabric has two tapering boundaries, tufting rows in a tapered formation between two boundaries to share an equal proportion of taper between each adjacent pair of rows.

35. A method of automatically tufting fabrics, comprising the steps of:

(a) stretching a backing fabric over a frame to form a grid network of filaments extending in at least two directions;

(b) traversing a tufting head over the backing under the influence of control signals, and reciprocating a needle in the tufting head into and out of the backing at a rate related to a speed of traverse of the tufting head, to insert tufts of yarn into the backing in accordance with a preselected pattern of tufts;

(c) determining at least one of the following factors:

a direction of traverse of the tufting head with respect to the filaments, any change in the direction of traverse, the yarn type and thickness, a rotational orientation of a tip of the needle with respect to the filaments, a distorting effect the needle has on the grid network of filaments when inserted into the backing, and the backing;

(d) adjusting the positions of the needle on the grid network relative to the positions of the tufts in the preselected pattern to compensate for positional errors introduced by the factors determined in (c); and (e) calculating an integral number of tufts along any given row in dependence on the spacing between that row and its immediately adjacent rows in order to ensure the tuft density remains within predetermined upper and lower limits.

36. A method of automatically tufting fabrics, comprising the steps of:

(a) stretching a backing fabric over a frame to form a grid network of filaments extending in at least two directions;

(b) traversing a tufting head over the backing under the influence of control signals, and reciprocating a needle in the tufting head into and out of the backing at a rate related to a speed of traverse of the tufting head, to insert tufts of yarn into the backing in accordance with a preselected pattern of tufts;

(c) determining at least one of the following factors:
a direction of traverse of the tufting head with respect to the filaments,
any change in the direction of traverse,
the yarn type and thickness,
a rotational orientation of a tip of the needle with respect to the filaments,
a distorting effect the needle has on the grid network of filaments when inserted into the backing, and
the backing;

(d) adjusting the positions of the needle on the grid network relative to the positions of the tufts in the preselected pattern to compensate for positional errors introduced by the factors determined in (c); and (e) displaying the predetermined pattern as a diagram showing arranged rows of tufts, wherein displayed tufts show their widths in scale with their lengths.

37. A method of automatically tufting fabrics, comprising the steps of:

(a) stretching a backing fabric over a frame to form a grid network of filaments extending in at least two directions;

(b) traversing a tufting head over the backing under the influence of control signals, and reciprocating a needle in the tufting head into and out of the backing at a rate related to a speed of traverse of the tufting head, to insert tufts of yarn into the backing in accordance with a preselected pattern of tufts;

(c) determining at least one of the following factors:
a direction of traverse of the tufting head with respect to the filaments,
any change in the direction of traverse,
the yarn type and thickness,
a rotational orientation of a tip of the needle with respect to the filaments,
a distorting effect the needle has on the grid network of filaments when inserted into the backing, and
the backing;

(d) adjusting the positions of the needle on the grid network relative to the positions of the tufts in the preselected pattern to compensate for positional errors introduced by the factors determined in (c); and (e) checking the predetermined pattern for any occurrences of localized tuft density falling outside predetermined upper and lower limits and modifying the pattern to compensate therefor.

38. A method of automatically tufting fabrics, comprising the steps of:

(a) stretching a backing fabric over a frame to form a grid network of filaments extending in at least two directions;

(b) traversing a tufting head over the backing under the influence of control signals, and reciprocating a needle in the tufting head into and out of the backing at a rate related to a speed of traverse of the tufting head, to insert tufts of yarn into the backing in accordance with a preselected pattern of tufts;

(c) determining at least one of the following factors:
a direction of traverse of the tufting head with respect to the filaments,
any change in the direction of traverse,
the yarn type and thickness,
a rotational orientation of a tip of the needle with respect to the filaments,
a distorting effect the needle has on the grid network of filaments when inserted into the backing, and
the backing;

(d) adjusting the positions of the needle on the grid network relative to the positions of the tufts in the preselected pattern to compensate for positional errors introduced by the factors determined in (c); and (e) pressing the tufting head against the backing during tufting at a preselected pressure to cause a desired deflection of the backing.

* * * * *